US007532841B2

(12) United States Patent
Tanaka

(10) Patent No.: US 7,532,841 B2
(45) Date of Patent: May 12, 2009

(54) PROTECTIVE COVER, PROCESS CARTRIDGE EMPLOYING SAME, IMAGE FORMING APPARATUS, AND METHOD OF INSTALLING PROCESS CARTRIDGE

(75) Inventor: Shigeru Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 300 days.

(21) Appl. No.: 11/486,048

(22) Filed: Jul. 14, 2006

(65) Prior Publication Data

US 2007/0206972 A1 Sep. 6, 2007

(30) Foreign Application Priority Data

Mar. 6, 2006 (JP) ..... P2006-060210

(51) Int. Cl.
*G03G 15/00* (2006.01)
*G03G 21/18* (2006.01)

(52) U.S. Cl. ..... 399/114; 399/110; 399/111; 399/108; 399/116

(58) Field of Classification Search ..... 399/110, 399/111, 114, 107, 108, 116
See application file for complete search history.

(56) References Cited

U.S. PATENT DOCUMENTS 4,551,000 A * 11/1985 Kanemitsu et al. ..... 399/111
4,655,578 A * 4/1987 Kurtz et al. ..... 399/114
4,766,455 A * 8/1988 Carter ..... 399/116
4,811,839 A * 3/1989 Cornell et al. ..... 206/303
5,196,884 A * 3/1993 Sugiyama et al. ..... 399/110
5,400,121 A * 3/1995 Foote ..... 399/116
5,666,586 A * 9/1997 Nishimura et al. ..... 399/13
5,708,924 A * 1/1998 Shogren et al. ..... 399/116
6,052,548 A * 4/2000 Yamamoto ..... 399/116
6,308,030 B1 * 10/2001 Taylor et al. ..... 399/121
6,389,252 B2 * 5/2002 Taylor et al. ..... 399/121
7,295,794 B2 * 11/2007 Asaoka et al. ..... 399/116

FOREIGN PATENT DOCUMENTS

JP 8-292706 11/1996

* cited by examiner

*Primary Examiner*—David M Gray
*Assistant Examiner*—G. M. Hyder
(74) *Attorney, Agent, or Firm*—Morgan, Lewis & Bockius LLP

(57) ABSTRACT

A protective cover that includes: a cover body detachably mounted on a process cartridge to protect at least an outwardly exposed part of an electro-photographic photoreceptor; a guide part that is provided on the cover body to guide the process cartridge in a longitudinal direction of the electro-photographic photoreceptor; and a position locking part that is provided at a forward end of the cover body in a direction that the process cartridge is inserted into an image forming apparatus wherein the cover body is positioned and locked to the image forming apparatus to be irremovable and forming a locked state during an installation of the process cartridge into the image forming apparatus, and the locked state is released after the installation is complete.

13 Claims, 19 Drawing Sheets

PROTECTIVE COVER, PROCESS CARTRIDGE EMPLOYING SAME, IMAGE FORMING APPARATUS, AND METHOD OF INSTALLING PROCESS CARTRIDGE

BACKGROUND

1. Technical Field

The present invention relates to a protective cover for a process cartridge which is employed in an image forming apparatus on electro-photographic system such as a copying machine, a facsimile, a printer, etc., and more particularly, to the protective cover which is advantageous in a method of installing the process cartridge in the image forming apparatus using the protective cover, the process cartridge employing the same, the image forming apparatus, and a method of installing the process cartridge.

2. Related Art

Generally, in an image forming apparatus utilizing electro-photographic system, a method in which an electro-photographic photoreceptor and electro-photographic processing devices acting on the electro-photographic photoreceptor are integrally incorporated in a process cartridge, and the process cartridge is detachably installed in a body of the image forming apparatus has been widely known. According to this method, workability in conducting maintenance of the image forming apparatus will be enhanced, and it will be possible for a user to conduct the maintenance of the image forming apparatus by himself, without an aid of a customer engineer.

The process cartridge of this type must be opened respectively at a position where the electro-photographic photoreceptor is opposed to a recording medium (such as a sheet of paper or an intermediate transfer body) during image formation, at a position where a light is irradiated from an exposing device, and further, at a position where the process cartridge is opposed to a developing device when the developing device is not integrally provided with the process cartridge. However, there has been such anxiety that a photoreceptive layer of the electro-photographic photoreceptor may be damaged during transportation of the process cartridge, and many structures for protecting the photoreceptive layer by employing a protective cover have been heretofore adopted. Usually, the protective cover of this type is detachably mounted on the process cartridge. There has been employed a method of installing the process cartridge in the image forming apparatus body, while separating the protective cover from the process cartridge at a time of installing the process cartridge, or by separating it in advance.

SUMMARY

According to an aspect of the invention, a protective cover includes a cover body detachably mounted on a process cartridge to protect at least an outwardly exposed part of an electro-photographic photoreceptor; a guide part that is provided on the cover body to guide the process cartridge in a longitudinal direction of the electro-photographic photoreceptor; and a position locking part that is provided at a forward end of the cover body in a direction that the process cartridge is inserted into an image forming apparatus wherein the cover body is positioned and locked to the image forming apparatus to be irremovable and forming a locked state during an installation of the process cartridge into the image forming apparatus, and the locked state is released after the installation is complete.

BRIEF DESCRIPTION OF THE DRAWINGS

An exemplary embodiment of the present invention will be described in detail based on the following figures, wherein.

DETAILED DESCRIPTION

Figure 1:
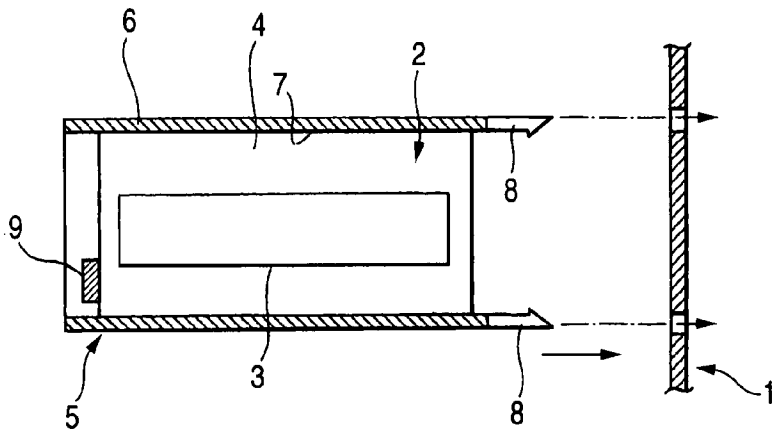
FIGS. 1 (*a*) and (*b*) are explanatory views showing an exemplary embodiment of a protective cover according to an aspect of the invention, in respective states before and after the protective cover is positioned and locked to an image forming apparatus. The drawings also schematically show a process cartridge and the image forming apparatus according to an aspect of the invention.
Figure 1:
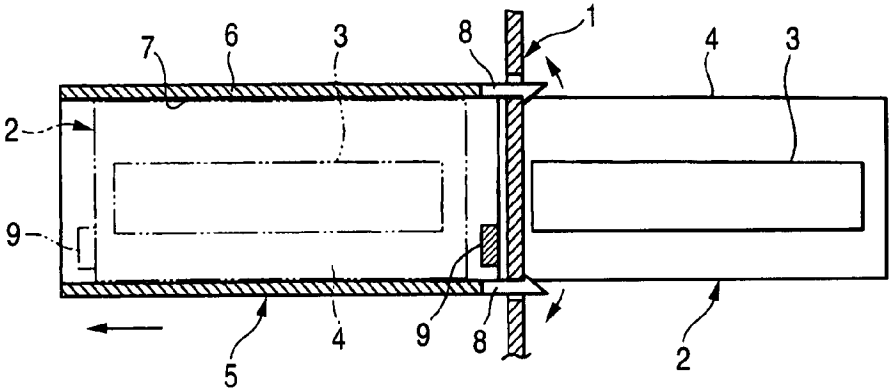

FIGS. 1(*a*) and (*b*) are explanatory views schematically showing an exemplary embodiment of a protective covert a process cartridge, and an image forming apparatus according to the invention in order to facilitate understanding of the invention.

Specifically, in the exemplary embodiment of the protective cover according to the invention, as shown in FIGS. 1(*a*) and (*b*), there is provided a protective cover 5 detachably mounted on a process cartridge 2 which is detachably inserted and installed into an image forming apparatus body 1 and contains at least an electro-photographic photoreceptor 3. The protective cover 5 is adapted to protect at least an outwardly exposed part of the electro-photographic photoreceptor 3 before installation of the process cartridge 2 in the image forming apparatus body 1 and during installation, and is detached from the process cartridge 2 after the installation of the process cartridge 2 has been completed. The protective cover 5 includes a cover body 6 which is detachably provided on the process cartridge 2 for protecting at least the outwardly exposed part of the electro-photographic photoreceptor 3, a guide part 7 which is provided on the cover body 6 to guide the process cartridge 2 in a longitudinal direction of the electro-photographic photoreceptor 3, and a position locking part 8 which is provided at a forward end of the cover body 6 in a direction of inserting the process cartridge 2 into the image forming apparatus body 1, in such a manner that the cover body 6 is positioned and locked with respect to the image forming apparatus body 1 to be irremovable during the installation of the process cartridge 2. The positioned and locked state can be released after the process cartridge 2 has been installed.

FIG. 1(*a*) is a schematic view showing a state just before the protective cover 5 is positioned and locked to the image forming apparatus body 1, and (*b*) is a schematic view showing a state after the protective cover 5 has been positioned and locked to the image forming apparatus body 1.

The process cartridge 2 has a unit containing at least the electro-photographic photoreceptor 3 integrally incorporated into a cartridge, and this unit incorporated in the cartridge is made attachable and detachable with respect to the image forming apparatus body 1.

Moreover, the protective cover 5 may be such a protective cover that it can protect at least the outwardly exposed part of the electro-photographic photoreceptor 3, for the purpose of preventing deterioration and damage mainly of the electro-photographic photoreceptor 3, before installation of the process cartridge 2 in the image forming apparatus body 1 and in process of the installation. The cover can be detached from the process cartridge 2 after the installation of the process cartridge 2 has been completed.

Herein, the description "it protects at least the outwardly exposed part of the electro-photographic photoreceptor 3" means such a feature that an object to be protected by the protective cover 5 includes only a part of the outwardly exposed part of the electro-photographic photoreceptor 3. The description may also include such a feature that only a part of the outwardly exposed part of the electro-photographic photoreceptor 3 is covered with the protective cover 5, while a remaining part of the outwardly exposed part of the electro-photographic photoreceptor 3 is covered with a protective member attached to the protective cover 5 (a sheet or a film). An entirety of the outwardly exposed part of the electro-photographic photoreceptor 3 may also be covered with the protective cover 5.

Moreover, the description "before installation of the process cartridge 2" includes, of course, such a feature that the protective cover 5 has been mounted from a stage of shipping and transporting the process cartridge 2, but the description is not limited to this feature. The description may also include such a feature that the process cartridge 2 is protected by a protective sheet or the like which is different from the protective cover 5 when the process cartridge 2 is shipped and transported, and the protective sheet or the like is removed just before installing the process cartridge 2 in the image forming apparatus body 1.

Further, it would be sufficient that the protective cover 5 is provided only with the cover body 6, the guide part 7, and the position locking part 8.

In this case, the cover body 6 is not limited to such a shape as surrounding an entirety of the process cartridge 2, but may be appropriately selected, provided that it covers at least the electro-photographic photoreceptor 3 and has a space for providing the guide part 7.

The guide part 7 is not limited to a structure of a rail shape, but may be appropriately selected, provided that the process cartridge 2 can be engaged with the guide part, and wall faces, for example, may be utilized.

Still further, although the position locking part 8 must be provided with both position function and locking function, it is not absolutely necessary that both the functions are used at the same position. For example, the position locking part 8 may include such a feature that a position part and a locking part are separately provided, to realize the position function in the position part and the irremovable locking function in the locking part, and both the position function and the locking function are achieved by combining both the parts. Moreover, it is of course possible to provide a simple position part in addition to the position locking part 8.

In the position locking part 8, the phrase "positioned and locked to be irremovable" means a locked state of the position locking part in which the cover body 6 cannot be removed until the locked state is released.

Meanwhile, the description "the positioned and locked state can be released after the process cartridge 2 has been installed" means not only such a feature that the locked state can be released at a time point when the installation of the process cartridge 2 has been completed, but also means that the locked state can be released even after the time point. In this case, although a feature of releasing the positioned and locked state in association with the inserting motion of the process cartridge 2 is desirable for releasing, releasing from the positioned and locked state may also be done independently without such association.

Moreover, in an exemplary embodiment of the position locking part 8, the position locking part 8 has both the function of position the cover body 6 and the function of locking the body to be irremovable. In this exemplary embodiment, it is possible to realize the position and locking function in a simple structure, by commonly using both the position function and the locking function.

Further, as an exemplary embodiment of the position locking part 8, there is a feature that the position locking part 8 includes a plurality of locking pieces which can be positioned and locked to a plurality of locking holes formed in the image forming apparatus body 1. In an exemplary embodiment having this feature, the position locking part 8 has elastic locking pieces which are elastically deformable, and locking hooks which can be locked to edges of position locking holes are formed at distal ends of these elastic locking pieces.

Moreover, a method of releasing the lock of the position locking part 8 may include a feature that the locked state with respect to the image forming apparatus body 1 can be released in association with the inserting and installing motion of the process cartridge 2 into the image forming apparatus body 1. In this method, it is possible to simply release the locked state of the position locking part 8 by making the releasing motion associated with the inserting motion of the process cartridge 2.

The lock releasing system of this type includes a push-out part 9 which is movably provided on the cover body 6 so as to push out the process cartridge 2 to be inserted into the image forming apparatus body 1. In this system, the push-out part 9 will release the locked state of the position locking part 8, when the installation of the process cartridge 2 has been completed by the push-out part 9.

Further, in the protective cover 5, the cover body 6 may have a cartridge fixing part (not shown) to which at least a part of the process cartridge 2 is fixed. This cartridge fixing part may be so constructed as to be released from the fixed state to the process cartridge 2 in association with a start of the inserting and installing motion of the process cartridge 2 into the image forming apparatus body 1. In this manner, because the cartridge fixing part will be released in association with the start of the inserting and installing motion of the process cartridge 2, it is possible to realize both protecting performance and detaching performance of the protective cover 5.

A system for releasing the fixed state of the cartridge fixing part of this type includes the push-out part 9 which is movably provided on the cover body 6 for pushing out the process cartridge 2 to be inserted into the image forming apparatus body 1. In this system, the push-out part 9 will release the fixed state of the cartridge fixing part with respect to the process cartridge 2, when the push-out part 9 starts to push out the process cartridge 2. In short, the fixed state by the cartridge fixing part may be released in association with operation of pushing out and inserting the process cartridge 2 (pushing out and inserting motion by the push-out part 9).

Moreover, the process cartridge according to an aspect of the invention is, as shown in FIG. 1, a process cartridge 2 which can be detachably inserted and installed into an image forming apparatus body 1 and includes at least an electro-photographic photoreceptor 3, and a cartridge frame 4 into which the electro-photographic photoreceptor 3 is incorporated, characterized in that the cartridge frame 4 has a protective cover 5 which protects at least an outwardly exposed part of the electro-photographic photoreceptor 3 before installation of the process cartridge 2 in the image forming apparatus body 1 and in process of the installation, and will be detached from the cartridge frame 4 after the installation of the process cartridge 2 has been completed, the protective cover 5 including a cover body 6 which is detachably provided on the cartridge frame 4 for protecting at least the outwardly exposed part of the electro-photographic photoreceptor 3, a guide part 7 which is provided on the cover body 6 to guide the cartridge frame 4 relatively movably in a longitudinal direction of the electro-photographic photoreceptor 3, and a position locking part 8 which is provided at a forward end of the cover body 6 in a direction of inserting the cartridge frame 4 into the image forming apparatus body 1, in such a manner that the cover body 6 is positioned and locked with respect to the image forming apparatus body 1 to be irremovable during the installation of the cartridge frame 4, and the positioned and locked state can be released after the cartridge frame 4 has been installed.

The process cartridge 2 herein described includes both the process cartridge 2 having the protective cover 5 before installation, and the process cartridge 2 which has been installed using the protective cover 5.

Particularly, as a feature of the process cartridge 2, a retaining part is provided in the cartridge frame 4 at a backward end in a withdrawing direction of the cartridge frame. The retaining part is adapted to be engaged with the image forming apparatus body 1 at the backward end in the withdrawing direction of the cartridge frame, when the cartridge frame is withdrawn from the image forming apparatus body, thereby temporarily stopping the withdrawing motion. This feature is a safety measure at a time of withdrawing the process cartridge 2, and drop of the process cartridge 2 can be effectively prevented by temporarily stopping the process cartridge 2 by the presence of the retaining part, when the process cartridge 2 is detached.

Further, a feature of the image forming apparatus according to an aspect of the invention is, as shown in FIG. 1, an image forming apparatus including an image forming apparatus body 1 into which a process cartridge 2 having at least an electro-photographic photoreceptor 3 is detachably inserted and installed, characterized in that the image forming apparatus has a protective cover 5 which protects at least an outwardly exposed part of the electro-photographic photoreceptor 3 before installation of the process cartridge 2 in the image forming apparatus body 1 and in process of the installation, and will be detached from the process cartridge 2 after the installation of the process cartridge 2 has been completed, the protective cover 5 including a cover body 6 which is detachably mounted on the process cartridge 2 for protecting at least the outwardly exposed part of the electro-photographic photoreceptor 3, a guide part 7 which is provided on the cover body 6 to guide the process cartridge 2 relatively movably in a longitudinal direction of the electro-photographic photoreceptor 3, and a position locking part 8 which is provided at a forward end of the cover body 6 in a direction of inserting the process cartridge 2 into the image forming apparatus body 1, in such a manner that the cover body 6 is positioned and locked with respect to the image forming apparatus body 1 to be irremovable during the installation of the process cartridge 2, and the positioned and locked state can be released after the process cartridge 2 has been installed.

Particularly, a feature of the image forming apparatus includes a stopper which is provided in the image forming apparatus body 1, and a retaining part which is provided at a backward end of the process cartridge 2 in a withdrawing direction, and adapted to be engaged with the stopper in the image forming apparatus body 1 at the backward end of the process cartridge 2 in the withdrawing direction, when the process cartridge 2 is withdrawn from the image forming apparatus body 1, thereby temporarily stopping the process cartridge 2. By employing such retaining structure (the stopper and the retaining part), it is possible to effectively prevent drop of the process cartridge 2 at the time of withdrawing operation.

Still further, a method of installing the process cartridge according to an aspect of the invention is, as shown in FIG. 1, a method of detachably inserting and installing a process cartridge 2 which has at least an electro-photographic photoreceptor 3 into an image forming apparatus body 1, including a protective cover locking step in which a protective cover 5 which is detachably mounted on the process cartridge 2 so as to cover at least the electro-photographic photoreceptor 3 is positioned and locked with respect to the image forming apparatus body 1 to be irremovable, a cartridge inserting step in which the process cartridge 2 is guided and inserted along the protective cover 5 which has been positioned and locked with respect to the image forming apparatus body 1, and a locked protective cover releasing step in which the locked state of the protective cover 5 with respect to the image forming apparatus body 1 is released, after the process cartridge 2 has been inserted.

Now, an aspect of the invention will be described in detail, referring to an exemplary embodiment as shown in the attached drawings.

Figure 2:
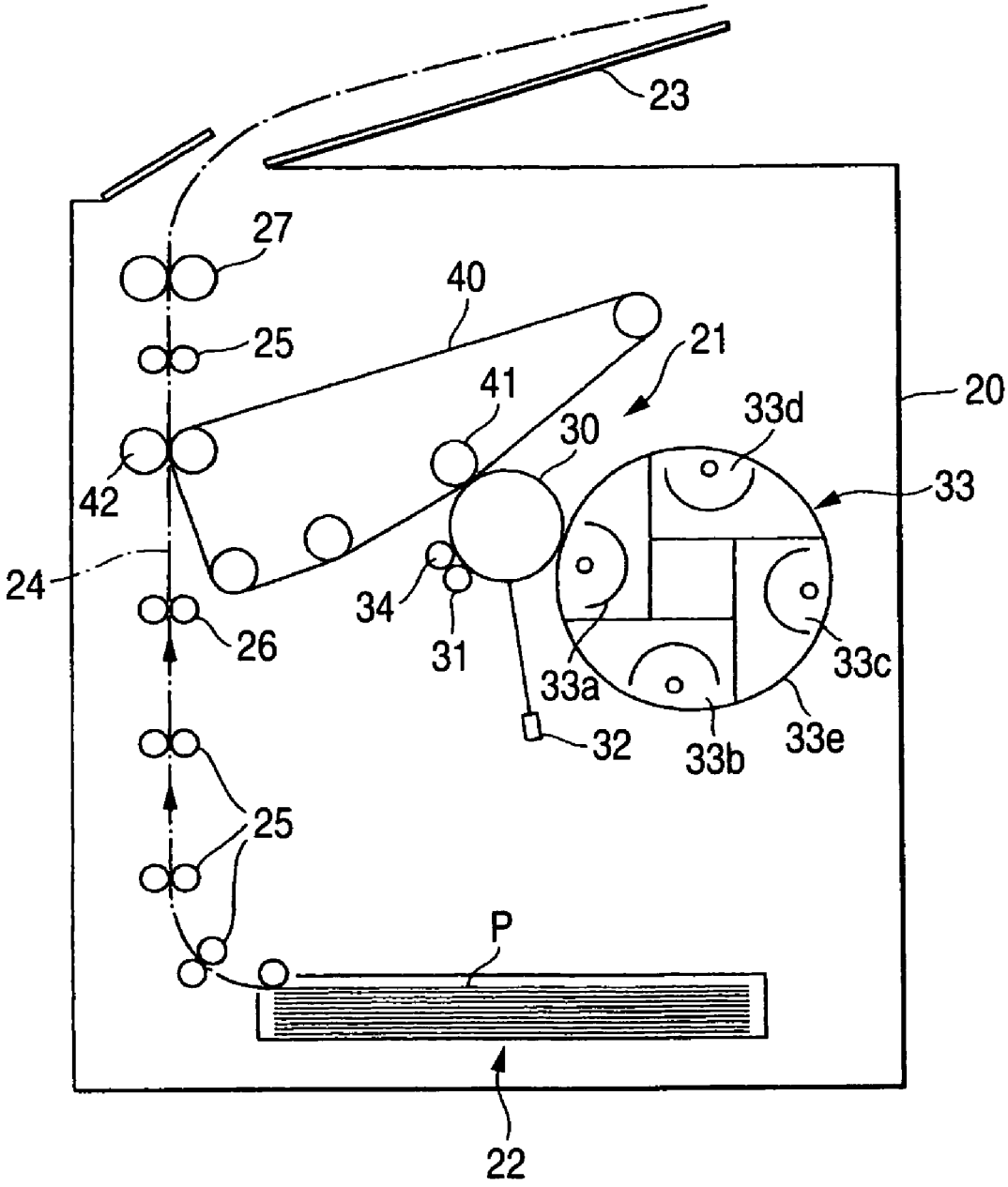
FIG. 2 is an explanatory view showing an exemplary embodiment of the image forming apparatus to which an aspect of the invention is applied.

FIG. 2 schematically shows an entire structure of the image forming apparatus to which an aspect of the invention is applied.

In FIG. 2, the image forming apparatus includes an image forming engine 21 which is provided in an apparatus casing (corresponding to the image forming apparatus body) 20, a supply tray 22 which is arranged below the image forming engine 21 for containing sheets of paper P as recording medium, a discharge tray 23 which is mounted on the top of the apparatus casing 20 and to which the recorded sheets are discharged, a sheet conveying path 24 extending in a substantially vertical direction from the supply tray 22 to the discharge tray through the image forming engine 21, an appropriate number of conveying rolls 25 which are provided along the sheet conveying path 24, registration rolls 26 for position and conveying the sheet P which are arranged just before the image forming engine 21 along the sheet conveying path 24, and further, a fixing device 27 which is arranged along the sheet conveying path 24 in a downstream from the image forming engine 21.

Moreover, in this exemplary embodiment, any image forming engine can be appropriately selected as the image forming engine 21, provided that it is of the electro-photographic system. For example, an engine of intermediate transfer type of the electro-photographic system, may be employed. This image forming engine 21 has a photoconductive drum 30 for electro-photography. Around the photoconductive drum 30, there are arranged an electrifying device (for example, an electrifying roll) 31, an exposing device (for example, a laser scanning device) 32, a rotary type developing device 33, and a cleaner 34 successively from upstream side. Further, an intermediate transfer belt 40 is provided at a position opposed to the photoconductive drum 30, and a primary transfer (for example, a primary transfer roll) device 41 is arranged on a back face of this intermediate transfer belt 40 at a position opposed to the photoconductive drum 30, and a secondary transfer device (for example, a secondary transfer roll) 42 is arranged along the intermediate transfer belt 40 at a position faced with the sheet conveying path 24.

In this exemplary embodiment, the rotary type developing device 33 includes a rotatable developing holder 33*e* which carries developing units 33*a* to 33*d* for respective colors, namely, yellow (Y), magenta (M), cyan (C), and black (K) so as to move intermittently. Moreover, a belt cleaner, which is not shown, is provided in a downstream from a secondary transfer position of the intermediate transfer belt 40.

Operation of the image forming apparatus as described above will be performed as follows;

In the image forming apparatus as shown in FIG. 2, the sheet P supplied from the supply tray 22 will be conveyed to the secondary transfer position by the secondary transfer roll 42, by means of the conveying rolls 25 and the registration rolls 26 along the sheet conveying path 24.

In synchronization with this motion, the electrifying device 31 will electrify a surface of the photoconductive drum 30, and the exposing device 32 will irradiate a laser beam based on image data to the surface of the photoconductive drum 30 which has been electrified, whereby an electrostatic latent image will be formed on the surface of the photoconductive drum 30. The electrostatic latent image will be developed by the rotary type developing device 33 in which the developing units 33*a* to 33*d* for the respective colors, namely, yellow (Y), magenta (M), cyan (C), and black (K) are circumferentially arranged, whereby a toner image of determined colors will be formed.

Then, the toner image developed on the surface of the photoconductive drum 30 will be transferred to a surface of the primary transfer belt 40 at the primary transfer position where the intermediate transfer belt 40 is opposed to the photoconductive drum 30, with a transferring electric field which acts on the primary transfer belt 41. After the primary transfer of the toner image to the intermediate transfer belt 40 has finished, the surface of the photoconductive drum 30 will be cleaned by the cleaner 34 at every one rotation of the photoconductive drum 30, and waste toner or the like will be removed.

Thereafter, the toner image on the surface of the intermediate transfer belt 40 will be transferred to the sheet P at the position where the secondary transfer roll 42 is opposed to the intermediate transfer belt 40, by a transferring electric field which acts on the secondary roll 42.

When a multi-colored image is formed, a determined number of steps for electrification, exposure, development, primary transfer and cleaning will be repeated, according to the number of colors for the image to be formed. In case of forming a full-colored image, for example, the developing units 33*a* to 33*d* in the rotary type developing device 33 for the corresponding colors will be sequentially moved to the developing position opposed to the photoconductive drum 30, and the toner images corresponding to the respective colors will be successively formed. The toner images of the respective colors, namely, yellow (Y), magenta (M), cyan (C), and black (K) which have been successively formed on the surface of the photoconductive drum 30 will be sequentially transferred to the surface of the intermediate transfer belt 40 at the primary transfer position, in a state superposed on one another. Then, the toner images of the respective colors, namely, yellow (Y), magenta (M), cyan (C), and black (K) which have been superposed on the surface of the intermediate transfer belt 40 will be transferred to the sheet P at the position where the secondary transfer roll 42 is opposed to the intermediate transfer belt 40, by a transferring electric field which acts on the secondary roll 42.

Thereafter, the sheet P to which the toner images have been transferred will be conveyed along the sheet conveying path 24 to the fixing device 27, and will be discharged to the discharge tray 23, after the toner images have been fixed.

The image forming apparatus according to the exemplary embodiment may be appropriately selected, as follows;

For example, as the developing method, it is possible to employ various developing methods such as two components magnetic brush developing method, cascade developing method, touchdown developing method, cloud developing method, etc. which are well known.

As the structure of the electrifying device 31 too, although a so-called contact electrifying method is employed in the above described exemplary embodiment, it would be apparent that as an alternative structure, a metallic shield of aluminum or the like is applied to a tungsten wire so as to cover it from three directions, and positive or negative ion which has been generated by inputting high voltage to the tungsten wire is moved to the surface of the photoconductive drum 30, thereby uniformly electrifying the surface of the drum.

Further, as the electrifying device 31, an electrifier of blade type (an electrifying blade), pad type, block type, rod type, wire type, etc. may be employed besides the above described roll type.

Also, as the method of cleaning the toner which remains on the photoconductive drum 30, it is possible to construct the cleaning means by employing a blade, a fur brush, a magnetic brush, etc.

Although the color image forming apparatus has been described as the image forming apparatus in the above described exemplary embodiment, an aspect of the invention is not necessarily limited to this, but an aspect of the invention can be preferably applied even to the image forming apparatus which records, for example, a monochromatic image. Moreover, although the laser beam printer has been exemplified as the image forming apparatus in the above described exemplary embodiment, an aspect of the invention is not necessarily limited to this, but it is of course possible to apply an aspect of the invention to the image forming apparatuses of other types, for example, an electro-photographic copying machine, a facsimile apparatus, or a word processor.

In this exemplary embodiment, the photoconductive drum 30 and the determined process devices (the electrifying device 31 and the cleaner 34, in this exemplary embodiment) are integrally constructed, as a process cartridge 50.

Figure 3:
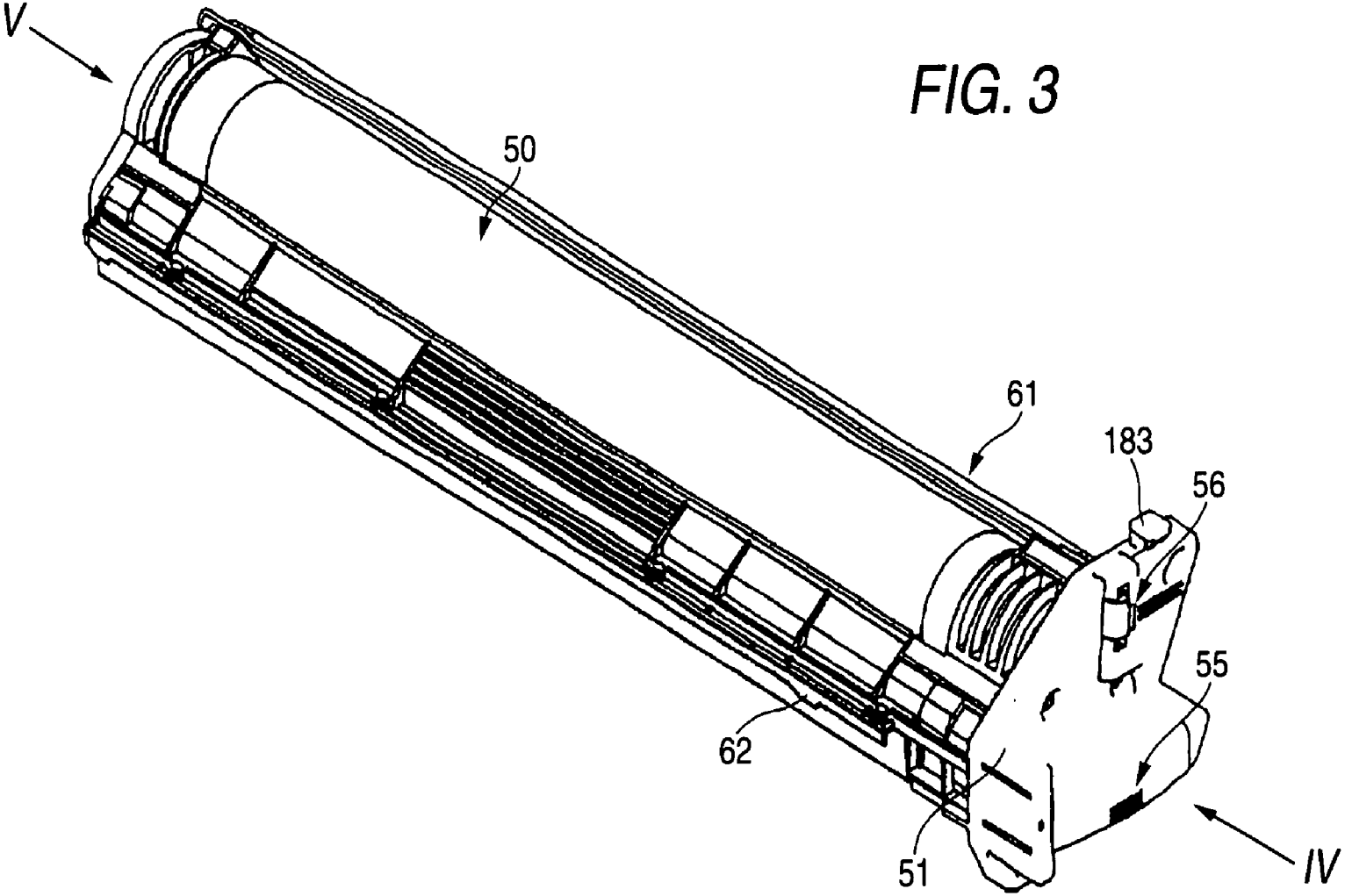
FIG. 3 is a perspective view schematically showing the process cartridge which is employed in this exemplary embodiment.
Figure 4:
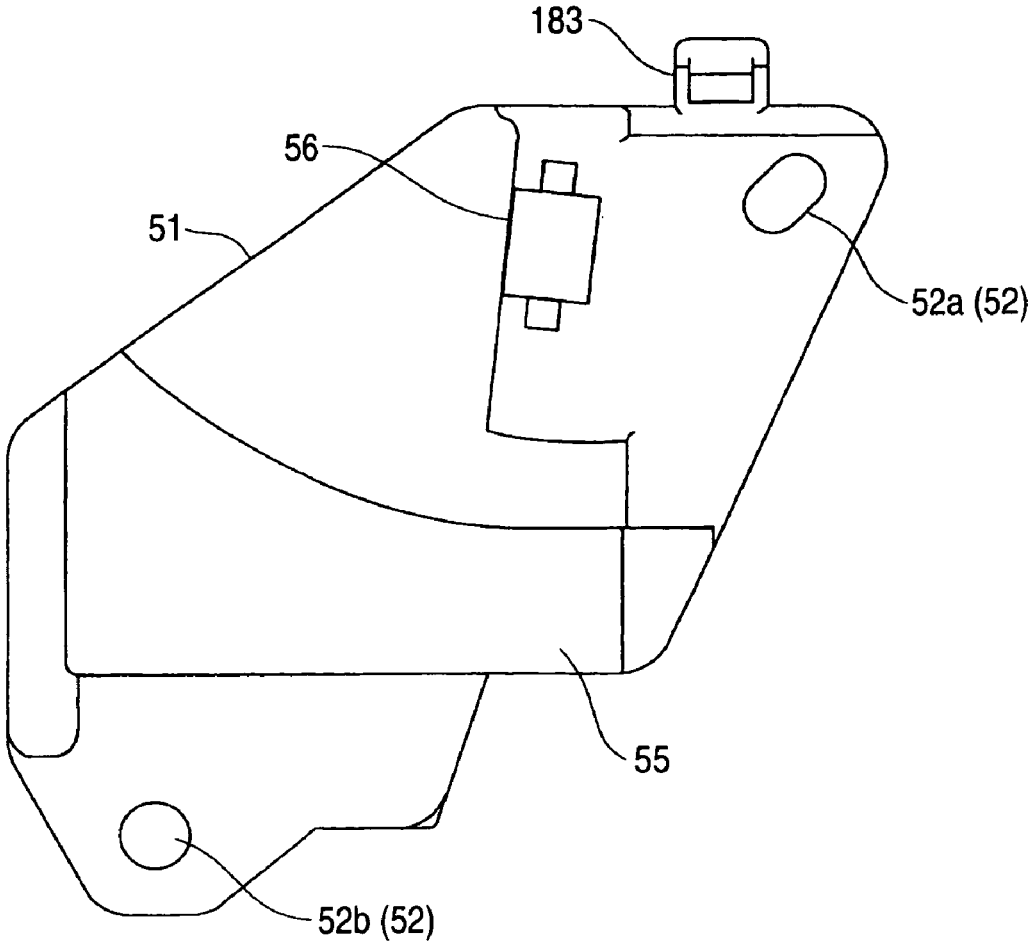
FIG. 4 is a view as seen from a direction of an arrow mark IV in FIG. 3.
Figure 5:
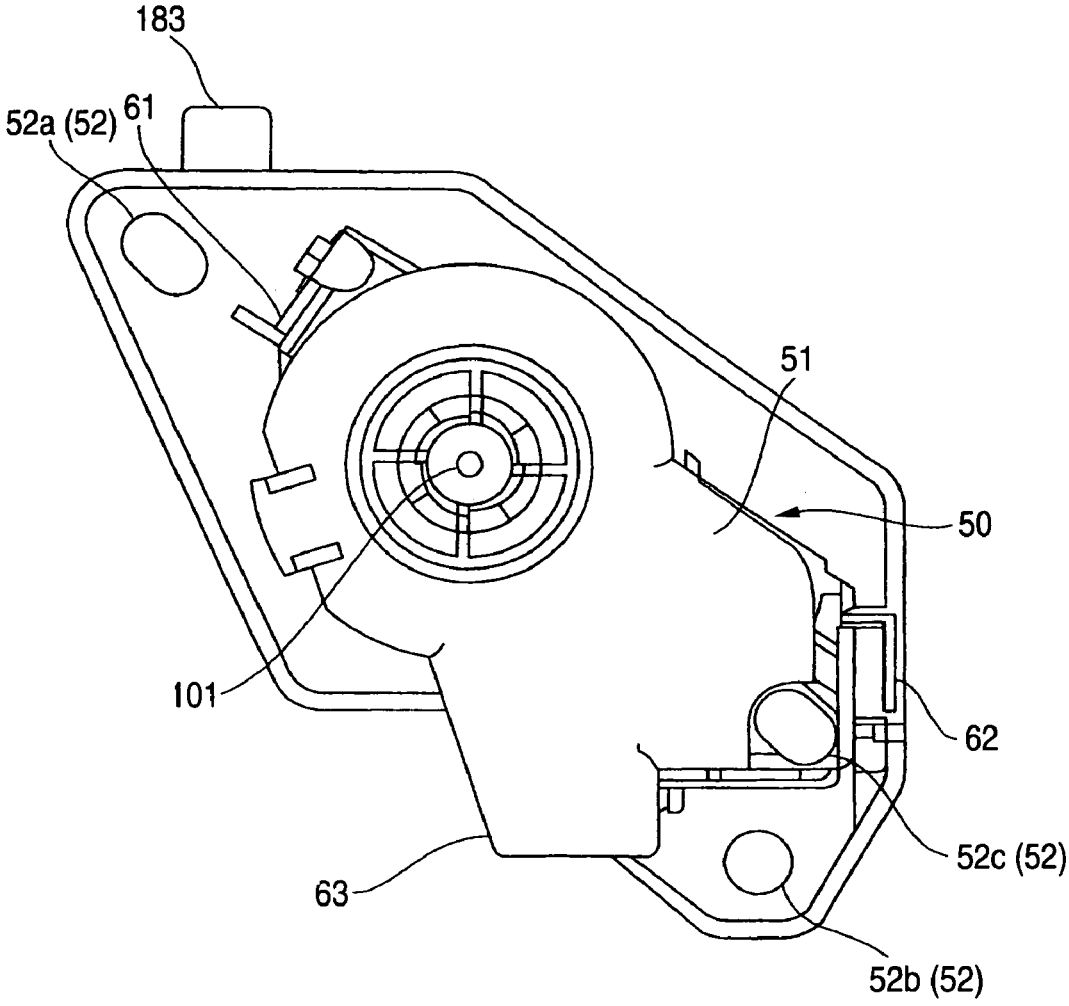
FIG. 5 is a view as seen from a direction of an arrow mark V in FIG. 3.

As shown in FIGS. 3 to 5, this process cartridge 50 has a cartridge frame 51 molded of synthetic resin such as ABS resin, and into this cartridge frame 51, the photoconductive drum 30, the electrifying device 31 and the cleaner 34 are integrally incorporated. FIG. 3 is a perspective view showing an entirety of the process cartridge 50 in a state installed in the apparatus casing 20, FIG. 4 is a view as seen in a direction of an arrow mark IV (a front side in a direction of withdrawing the process cartridge 50) in FIG. 3, and FIG. 5 is a view as seen in a direction of an arrow mark V (a back side in the direction of withdrawing the process cartridge 50) in FIG. 3.

Figure 14:
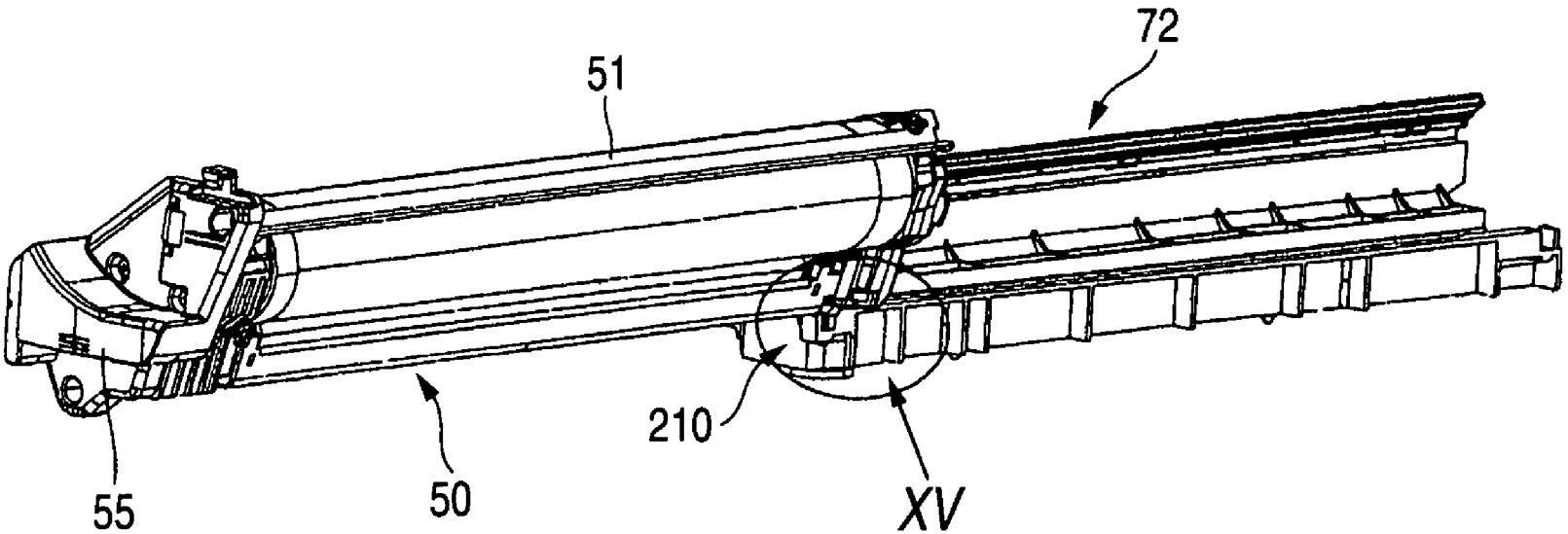
FIG. 14 is an explanatory view showing a state where the process cartridge is being withdrawn from the image forming apparatus body.

Moreover, a handle 55 for withdrawing the process cartridge 50 is provided at an end of the cartridge frame 51 in the withdrawing direction (See FIG. 14).

The structure of the process cartridge 50 is not limited to the above described mode, but can be also applied to a mode for forming a monochromatic image, or a mode for forming an image having a plurality of colors (for example, a two color image, a three color image or a full color image), by providing a plurality of developing devices.

Further, as an arrangement of the process cartridge 50, besides the above described arrangement, there are various arrangements in which only the photoconductive drum 30 is contained in the cartridge, the photoconductive drum 30 and the electrifying device 31 are integrally incorporated in the cartridge to be detachably installed in the apparatus casing 20, the photoconductive drum 30 and the developing device are integrally incorporated in the cartridge to be detachably installed in the apparatus casing 20, the photoconductive drum 30 and the cleaner 34 are integrally incorporated in the cartridge to be detachably installed in the apparatus casing 20, and further, the photoconductive drum 30 and at least two of the aforesaid process devices are combined to be integrally incorporated in the cartridge to be detachably installed in the apparatus casing 20, and so on.

Now, elements of the process cartridge 50 to be employed in this exemplary embodiment will be described.

The photoconductive drum 30 has a connection receiving part 101 at its back side in the withdrawing direction. This connection receiving part 101 is adapted to be connected to a rotation drive shaft 102 (See FIG. 6) which is a drive source incorporated in the apparatus casing 20. This connecting structure serves also as a position member for positioning the process cartridge 50 with respect to the apparatus casing 20.

Moreover, the electrifying device 31 employs the contact electrifying method, in which an electrically conductive roll 111 (See FIG. 7) is brought into contact with the photoconductive drum 30, and electric voltage is applied to this conductive roll 111, thereby to uniformly electrify the photoconductive drum 30. In this electrifying device 31, the conductive roll 111 is rotated following the rotation of the photoconductive drum 30. The electrifying device 31 is so constructed that the conductive roll 111 and a cleaning brush 112 for cleaning the conductive roll 111 are integrally incorporated in the cartridge frame 51.

Further, the cleaner 34 will remove and recover the toner which has remained on the photoconductive drum 30 (hereinafter referred to as waste toner) after the toner images which have been formed by the developing units 33*a* to 33*d* in the rotary type developing device 33 have been transferred to the intermediate transfer belt 40, and will discharge the waste toner to a waste toner receiving part (not shown) mounted on the process cartridge 50. In this exemplary embodiment, the cleaner 34 is constructed in such a manner that an elastic cleaning blade 121 for scraping off the waste toner on the photoconductive drum 30, a pickup sheet 122 for preventing the waste toner which has been scraped off from overflowing to the photoconductive drum 30, and a waste toner conveying screw 123 for conveying the waste toner which has been scraped off to the waste toner receiving part are integrally incorporated in the cartridge frame 51.

Figure 6:
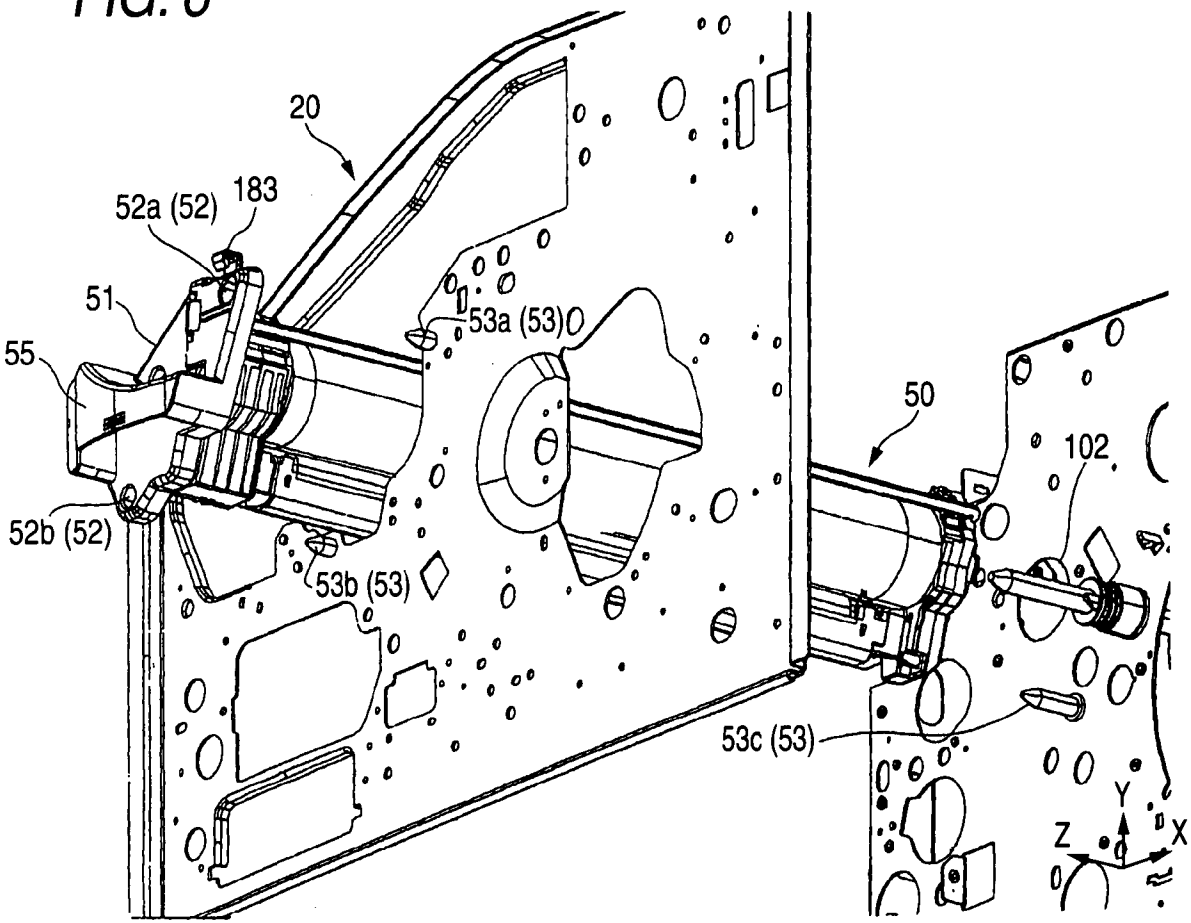
FIG. 6 is an explanatory view showing an example of position the process cartridge employed in the exemplary embodiment with respect to an image forming apparatus body.

Still further, in this exemplary embodiment, the cartridge frame 51 has a plurality of (two at one side and one at the other side, in this exemplary embodiment) position holes 52 (Specifically, 52*a* to 52*c*) for positioning the process cartridge 50 with respect to the apparatus casing 20, at both sides in a longitudinal direction thereof. The apparatus casing 20 is provided with position pins 53 (Specifically, 53*a* to 53*c*), so as to project from respective positions corresponding to the position holes 52 (52*a* to 52*c*) of this cartridge frame 51, as shown in FIG. 6, for example. The position pins 53 (53*a* to 53*c*), are adapted to be respectively positioned and engaged with the position holes 52 (52*a* to 52*c*) of the cartridge frame 51, at a stage when the process cartridge 50 has been inserted and installed into the apparatus casing 20 at a determined position.

As described above, in this exemplary embodiment, the rotation drive shaft 102 of the apparatus casing 20 is connected to the connection receiving part 101 of the photoconductive drum 30, and at the same time, the position pins 53 (53*a* to 53*c*) of the apparatus casing 20 are positioned and engaged with the position holes 52 (52*a* to 52*c*) of the cartridge frame 51, whereby the process cartridge 50 can be accurately positioned with respect to the apparatus casing 20.

Moreover, in this exemplary embodiment, the process cartridge 50 is provided with the electrifying device 31 and the cleaner 34 below a horizontal line including a center of the photoconductive drum 30 in a direction of weight. By arranging the electrifying device 31 below the photoconductive drum 30 in this manner, it has become possible to use a part of the cartridge frame 51 as a position part for positioning the process cartridge 50 with respect to the protective cover 150 or as a guide part for guiding the process cartridge 50 when it is inserted into the apparatus casing 20. Therefore, positioning elements or guiding elements which have to be separately provided can be decreased, and this would be advantageous in realizing space saving and reduction of components in number which have been keenly required in recent years.

Figure 7:
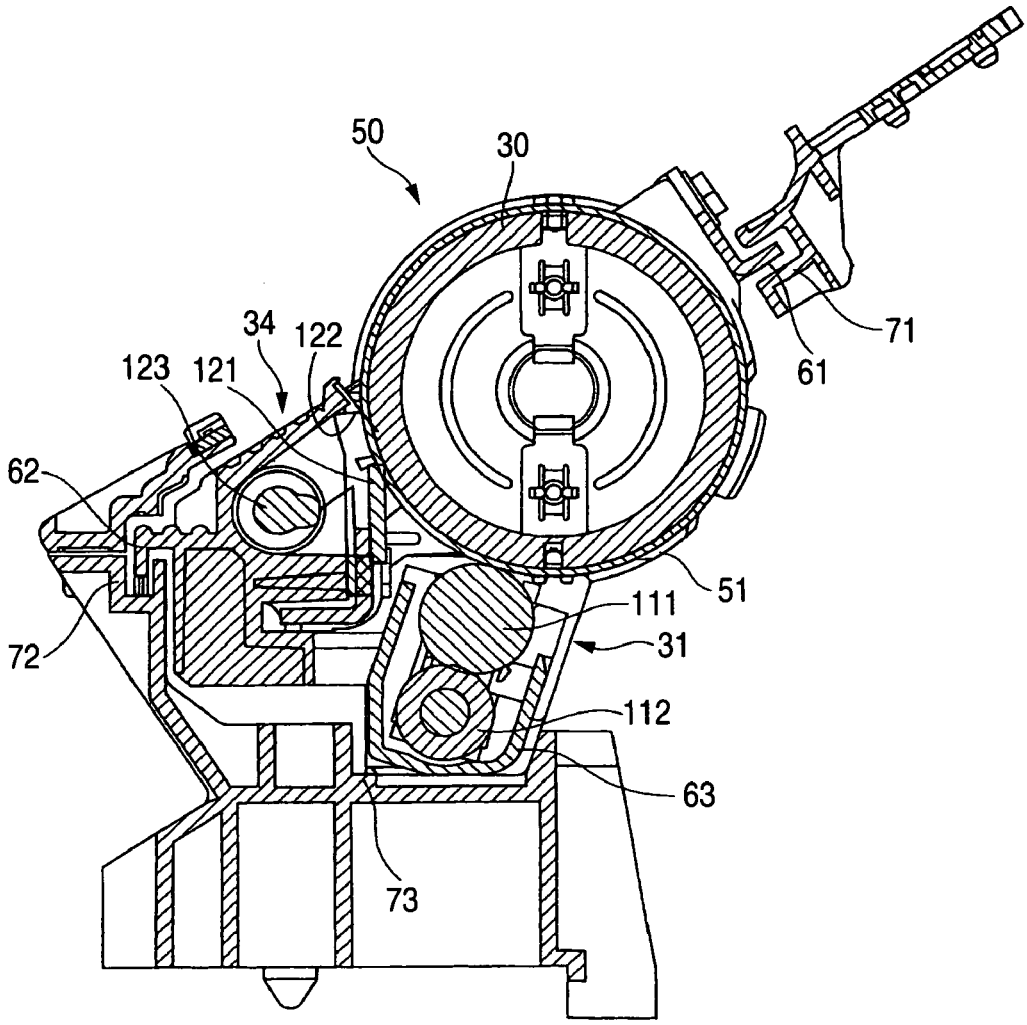
FIG. 7 is an explanatory view showing an example of a guide structure of the process cartridge employed in the exemplary embodiment, inside the image forming apparatus body.

Further, in this exemplary embodiment, when the process cartridge 50 is inserted and installed at the determined position (a cartridge receiving part) in the apparatus casing 20, as shown in FIG. 7, the process cartridge 50 is adapted to be guided by sliding guide ridges 61, 62 which are formed on the cartridge frame 51, and a case outer wall 63 of the electrifying device respectively along the guide rails 71, 72, and a guide wall 73 which are provided in the apparatus casing 20, thereby to maintain its inserted posture in a determined shape.

Figure 8:
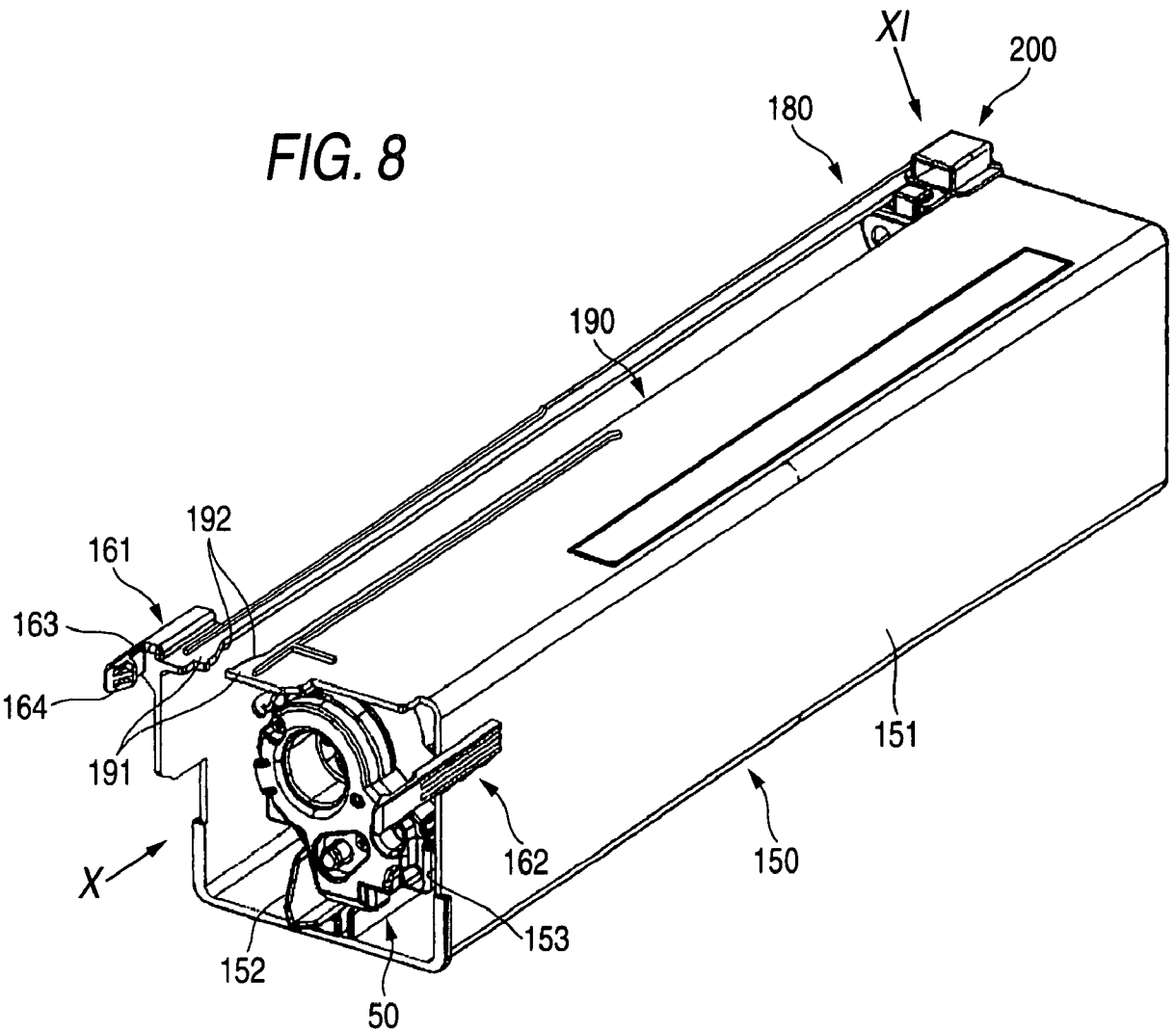
FIG. 8 is an explanatory view showing an outer appearance of the protective cover, in a state where the protective cover is mounted on the process cartridge employed in the exemplary embodiment.
Figure 9:
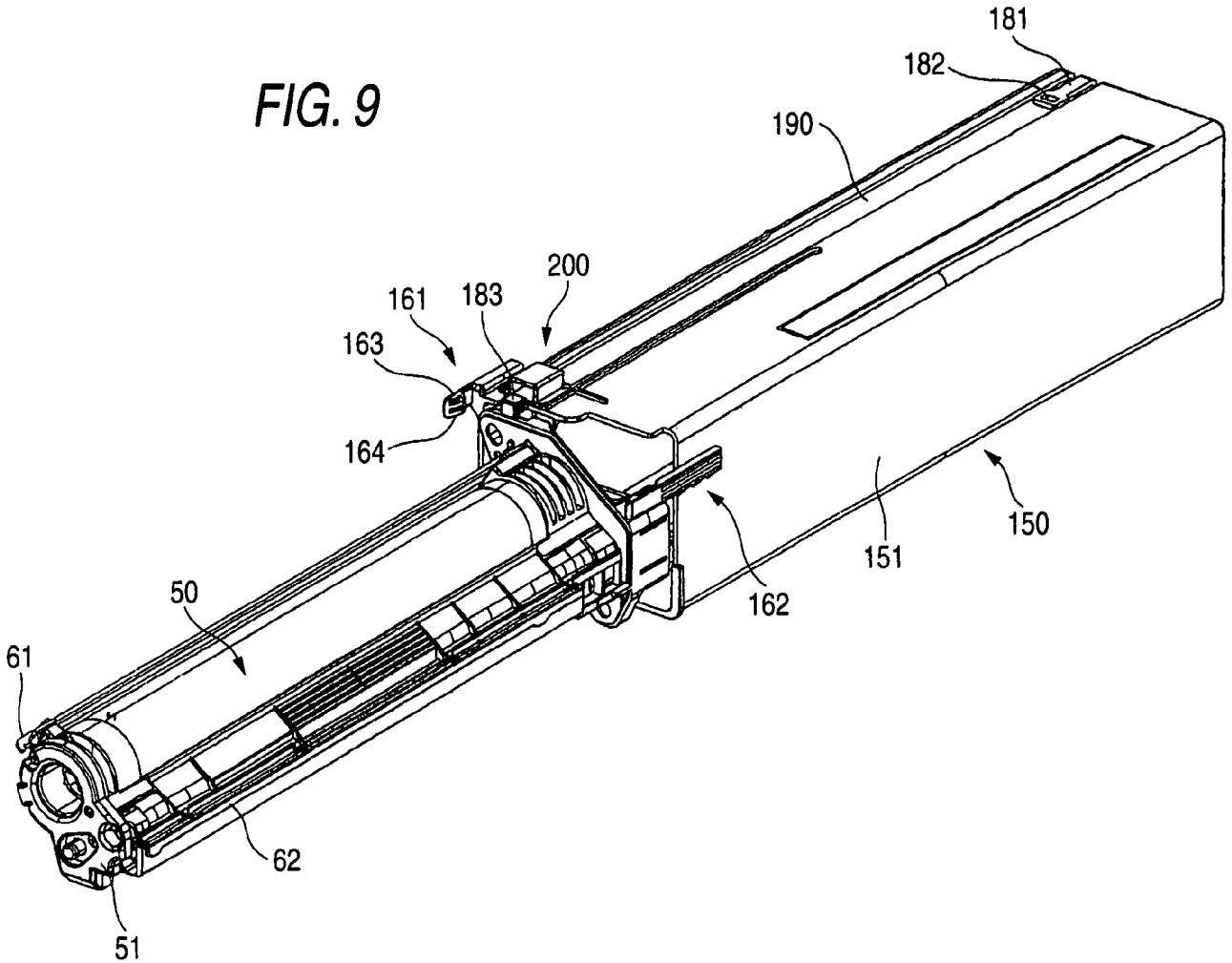
FIG. 9 is an explanatory view showing the process cartridge employed in the exemplary embodiment, in a state where the process cartridge is being detached from the protective cover.
Figure 10:
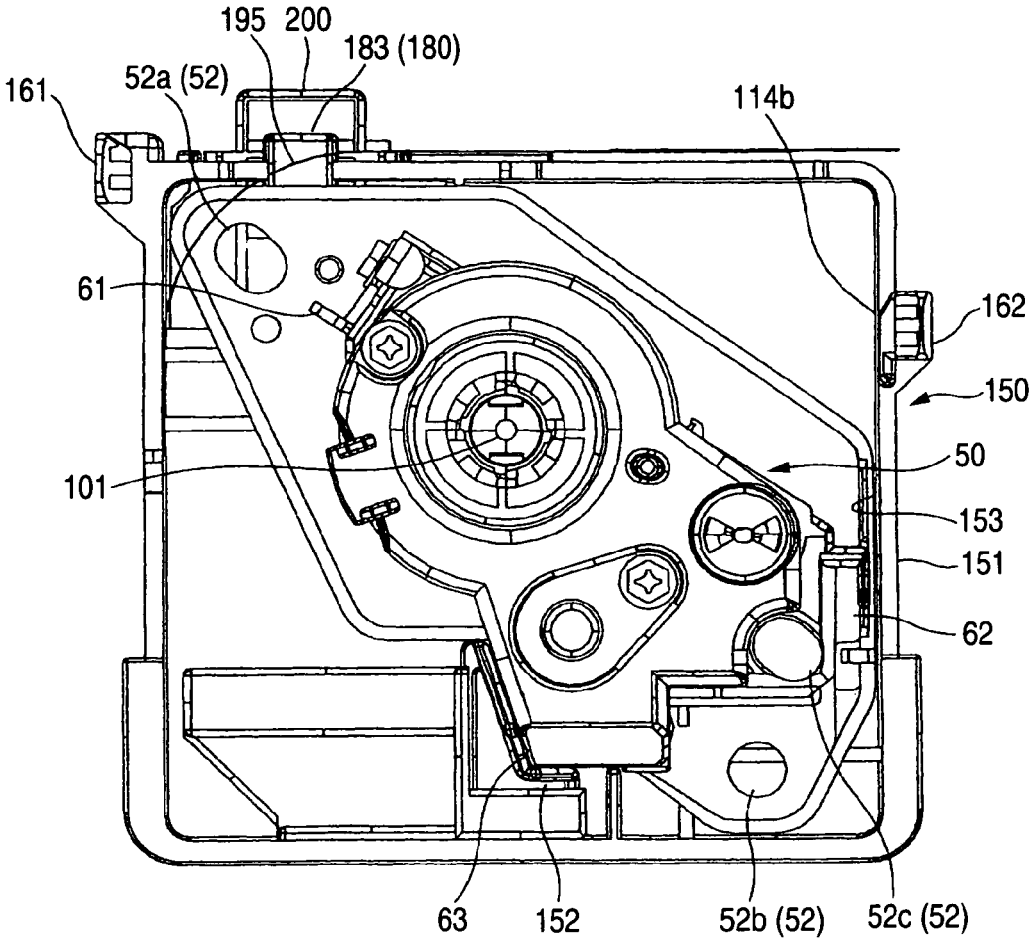
FIG. 10 is a view as seen from a direction of an arrow mark X in FIG. 8.

In this exemplary embodiment, the process cartridge 50 has a protective cover 150 before installation in the apparatus casing 20 and in process of the installation, as shown in FIGS. 8 to 10. This protective cover 150 is detachably mounted on the process cartridge 50 so as to protect an exposed part of the photoconductive drum 30 from the process cartridge 50 and so as to be detached after the process cartridge 50 has been installed in the apparatus casing 20.

In this exemplary embodiment, the protective cover 150 has a cover body 151 which has a substantially hollow cubical shape surrounding the entire process cartridge 50, and extends in a longitudinal direction. This cover body 151 is integrally formed of synthetic resin such as ABS resin, for example.

This cover body 151 is provided with a guide rail 152 and a guide inner wall 153 at respective positions corresponding to the guide ridges 61, 62 of the cartridge frame 51, and the case outer wall 63 of the electrifying device 31. Specifically, in this exemplary embodiment, the guide rail 152 is formed on an inner face of a bottom wall of the cover body 151, and adapted to guide the guide ridge 62 of the cartridge frame 51 by sliding. The guide inner wall 153 is formed on an inner face of a side wall of the cover body 151, and adapted to guide the case outer wall 63 of the electrifying device 31 by sliding, so that the inserted posture of the process cartridge 50 may be restricted.

Figure 12:
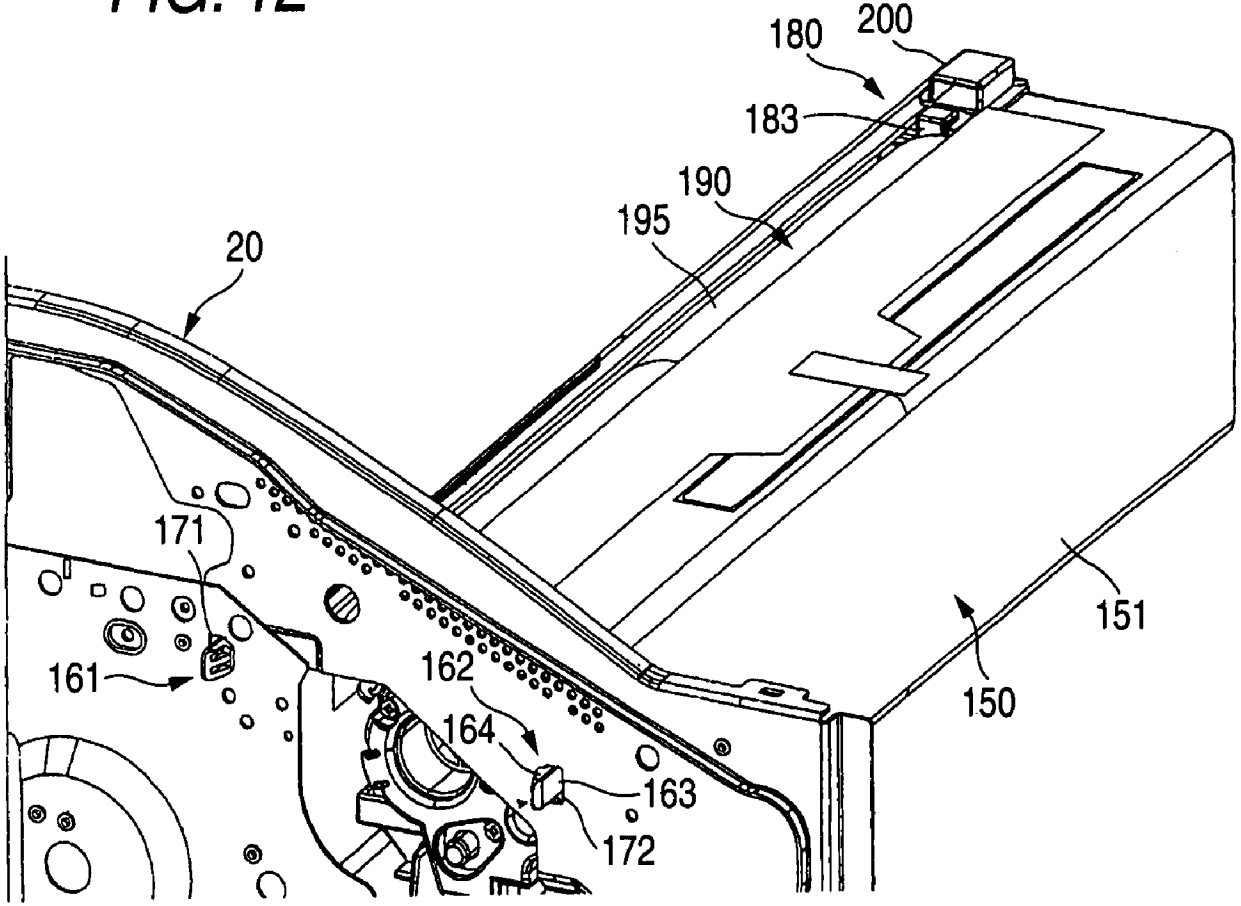
FIG. 12 is an explanatory view showing the protective cover in a state positioned and locked with respect to the image forming apparatus body.

Further, the cover body 151 is provided with a pair of position locking pieces 161, 162 at both sides of its one end in the longitudinal direction. Each of these position locking pieces 161, 162 has an elastic locking piece 163 which projects from the end of the cover body 151 in the longitudinal direction toward the apparatus casing 20, and a locking hook 164 is integrally formed with this elastic locking piece 163. The elastic locking piece 163 is formed in a shape of a plate having thin wall thickness in a vertical direction, and its free end portion is tiltable in a substantially horizontal direction. On the other hand, the apparatus casing 20 has a pair of position locking holes 171, 172 (See FIGS. 12 and 13) at a circumferential edge of an opening for receiving the cartridge. The position locking pieces 161, 162 are inserted into these position locking holes 171, 172 while elastically deformed, and positioned. At the same time, the locking hooks 164 of the position locking pieces 161, 162 will be locked to respective edges of the position locking holes 171, 172 to be irremovable.

Moreover, in this exemplary embodiment, as shown in FIGS. 8 to 12, a locking mechanism (corresponding to a cartridge fixing part in an exemplary embodiment according to the invention) 180 for fixing the process cartridge 50 is provided on an upper wall of the cover body 151 of the protective cover 150, at a front side in the longitudinal direction. This locking mechanism 180 includes an elastic projecting piece 181 provided on the cover body 151. The elastic projecting piece 181 is elastically deformable in a vertical direction and formed with a lock hole 182. On the other hand, a lock arm 183 in a hook-like shape is provided at a front side in the longitudinal direction (at a front side in the withdrawing direction) of the cartridge frame 51 of the process cartridge 50, so that the lock arm 183 may be engaged with and disengaged from the lock hole 182 of the elastic projecting piece 181, in a state where the elastic arm 181 is elastically deformed.

Further, in this exemplary embodiment, a guide slit 190 containing the elastic projecting piece 181 of the aforesaid locking mechanism 180 is formed along the longitudinal direction on the upper wall of the cover body 151 of the protective cover 150. The guide slit 190 is open at an edge of the cover body 151 at a side of the apparatus casing 20, and has a long size. In this guide slit 190, a push lever 200 is adapted to slidably move. Retaining steps 191 are formed inside the guide slit 190 in an area near its opening, and an opening width of the guide slit 190 is set to be smaller in this area. Moreover, in a part of the guide slit 190 before the retaining steps 191, there are formed taper parts 192 which make the opening width gradually narrower.

In this exemplary embodiment, the push-out lever 200 has a lever body 201 which opens in a substantially U-shape toward an opening end of the guide slit 190. A pair of leg portions 202 which are slidably engaged with edges of the guide slit 190 are projected downwardly from a bottom wall of the lever body 201. This bottom wall of the lever body 201 is provided with a locking taper part 203 at an opening end of the guide slit 190. The elastic projecting piece 181 of the aforesaid locking mechanism 180 will be pushed down by this locking taper part 203, thereby to release the engagement between the lock hole 182 of the elastic projecting piece 181 and the lock arm 183, and at the same time, the locking taper part 203 will be engaged with the lock arm 183 thereby to push out the process cartridge 50 along the guide slit 190.

Still further, in this exemplary embodiment, as the push-out lever 200 slides along the guide slit 190 toward the apparatus casing 20, it arrives at the taper parts 192 of the retaining steps 191 of the guide slit 190. When the push-out lever 200 has arrived at the taper parts 192 of the guide slit 190, the opening end of the guides lit 190 will be spread outwardly, because a gap between the taper parts 192 of the guide slit 190 is smaller than a distance between the leg portions 202 of the push-out lever 200. Accordingly, a pair of the position locking pieces 161, 162 will be spread so as to be separated from each other. In this state, it is possible to extract the position locking pieces 161, 162 from the position locking holes 171, 172, by moving the protective cover 150 in a direction of withdrawing, since the locking hooks 164 of the position locking pieces 161, 162 have been already separated from the edges of the position locking holes 171, 172.

In this manner, the push-out lever 200 acts as an operating member for releasing the engaged state of the locking pieces 161, 162 with respect to the apparatus casing 20, in this exemplary embodiment.

In order to remove the process cartridge 50 from the apparatus casing 20, operation for withdrawing the process cartridge 50 will be conducted. In this exemplary embodiment, a retaining mechanism 210 is provided between an opening edge of the apparatus casing 20 and a backward end of the process cartridge 50 in the withdrawing direction.

Figure 15:
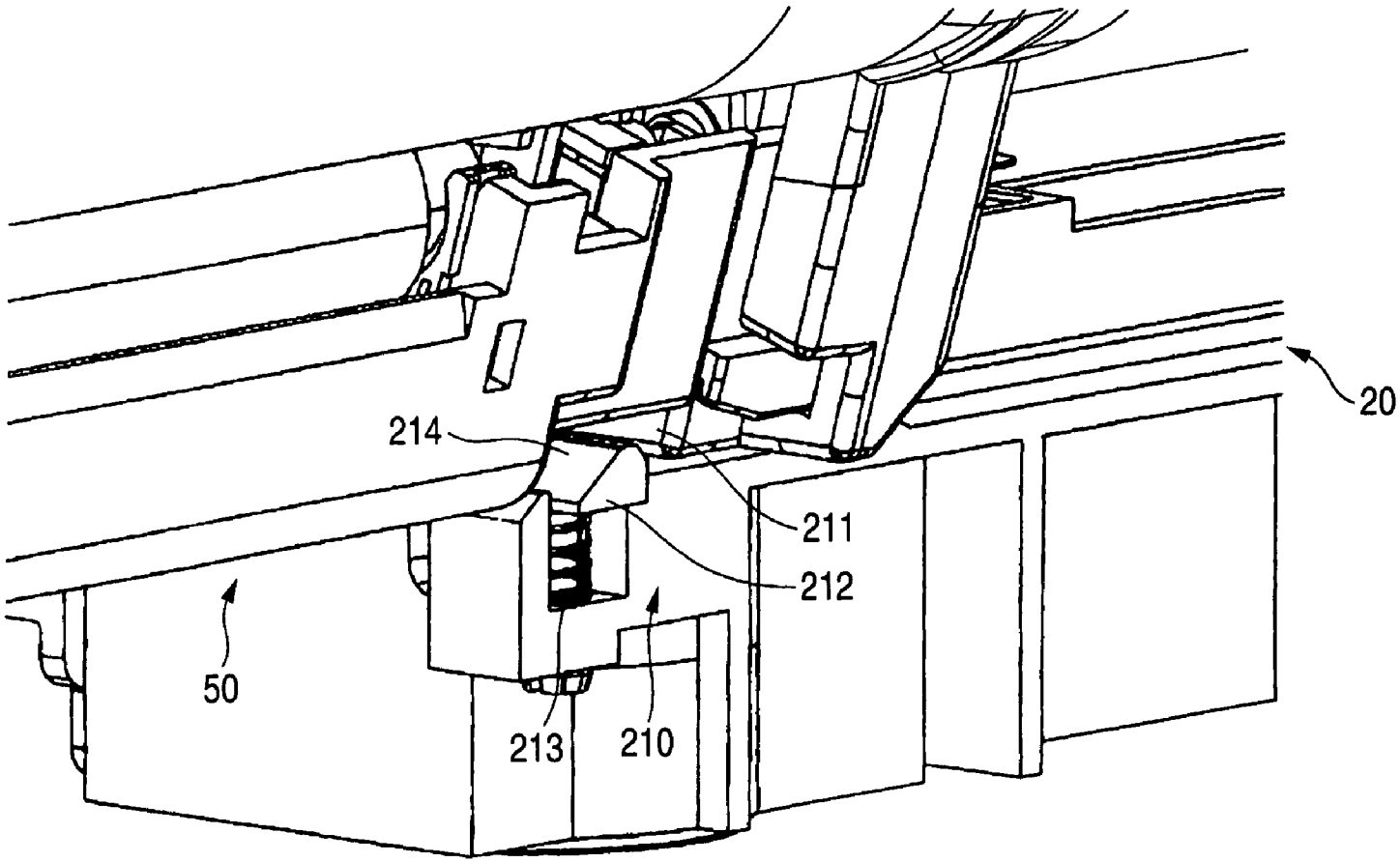
FIG. 15 is an explanatory view showing details in an area XV in FIG. 14.

As shown in FIGS. 14 and 15, in this retaining mechanism 210, for example, a retaining piece 211 projecting downwardly is provided at a backward end of the cartridge frame 51 of the process cartridge 50 in the withdrawing direction. On the other hand, a movable stopper 212 capable of freely projecting and retracting is provided near an inlet of the guide rail 71 which is formed in the apparatus casing 20, so as to be urged upwardly by a spring 213. Further, the movable stopper 212 is provided with a taper part 214 for enabling the movable stopper 212 to be pushed down by the retaining piece 211 in an inserting direction of the process cartridge 50, whereby the retaining piece 211 is engaged with the movable stopper 212 to temporarily stop the process cartridge 50 against the withdrawing direction.

Method of installing the process cartridge 50 with the protective cover 150 mounted thereon will be described, referring to FIGS. 16 and 17.

Figure 16:
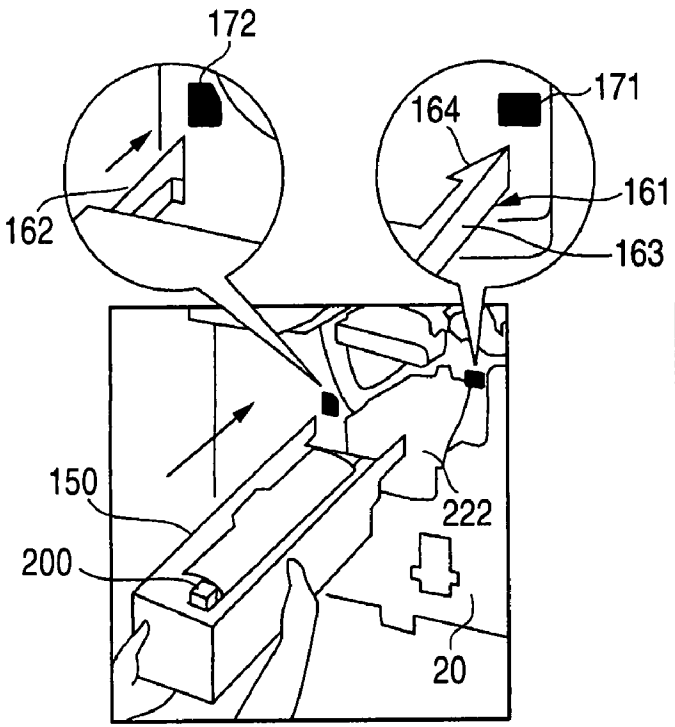
FIGS. 16(*a*) to (*c*) are explanatory views showing process of installing the process cartridge.
Figure 16:
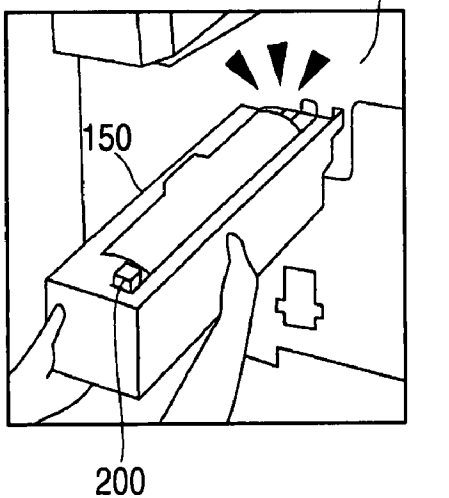
Figure 16:
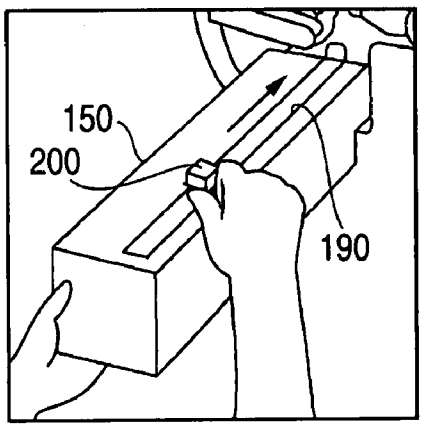

As a first step, the position locking pieces 161, 162 provided on the protective cover 150 will be inserted into the position locking holes 171, 172 which are formed in an edge part of the cartridge inserting mouth (See FIG. 16(*a*)). On this occasion, the position locking pieces 161, 162 will be engaged with the position locking holes 171, 172, and the protective cover 150 and the process cartridge 50 will be positioned with respect to the apparatus casing 20, and locked thereto so as not to be withdrawn (See FIG. 16(*b*)).

In this state, because the protective cover 150 has been positioned with respect to the apparatus casing 20 and fixed thereto so as not to be withdrawn, drop of the protective cover 150 can be effectively prevented, even though the protective cover 150 is not held by hand, while the process cartridge 50 is inserted.

Further, in this exemplary embodiment, because the position locking pieces 161, 162 are engaged with the position locking holes 171, 172 in the apparatus casing 20, and the end part of the protective cover 150 is in contact with the edge part of the cartridge inserting mouth in the apparatus casing 20, it is possible to prevent the process cartridge 50 from being inclined with respect to the inserting direction when it is inserted into the apparatus casing 20, even though the protective cover 150 is not held by hand during the insertion of the process cartridge 50.

Further, beside the mode wherein the end part of the protective cover 150 is brought into contact with the edge part of the cartridge inserting mouth of the apparatus casing 20, substantially the same can be obtained, by employing a mode of preparing another pair of the aforesaid position locking pieces and position locking holes, a mode of bringing a projection into contact with a receiving part for the projection, and a mode of bringing at least a part of the end part of the protective cover 150 into contact with at least a part of the edge part of the cartridge inserting mouth of the apparatus casing 20.

Moreover, as shown in FIG. 8, the lock mechanism 180 which fixes the process cartridge 50 to the protective cover 150 is provided on respective front end parts of the protective cover 150 and the process cartridge 50.

Figure 11:
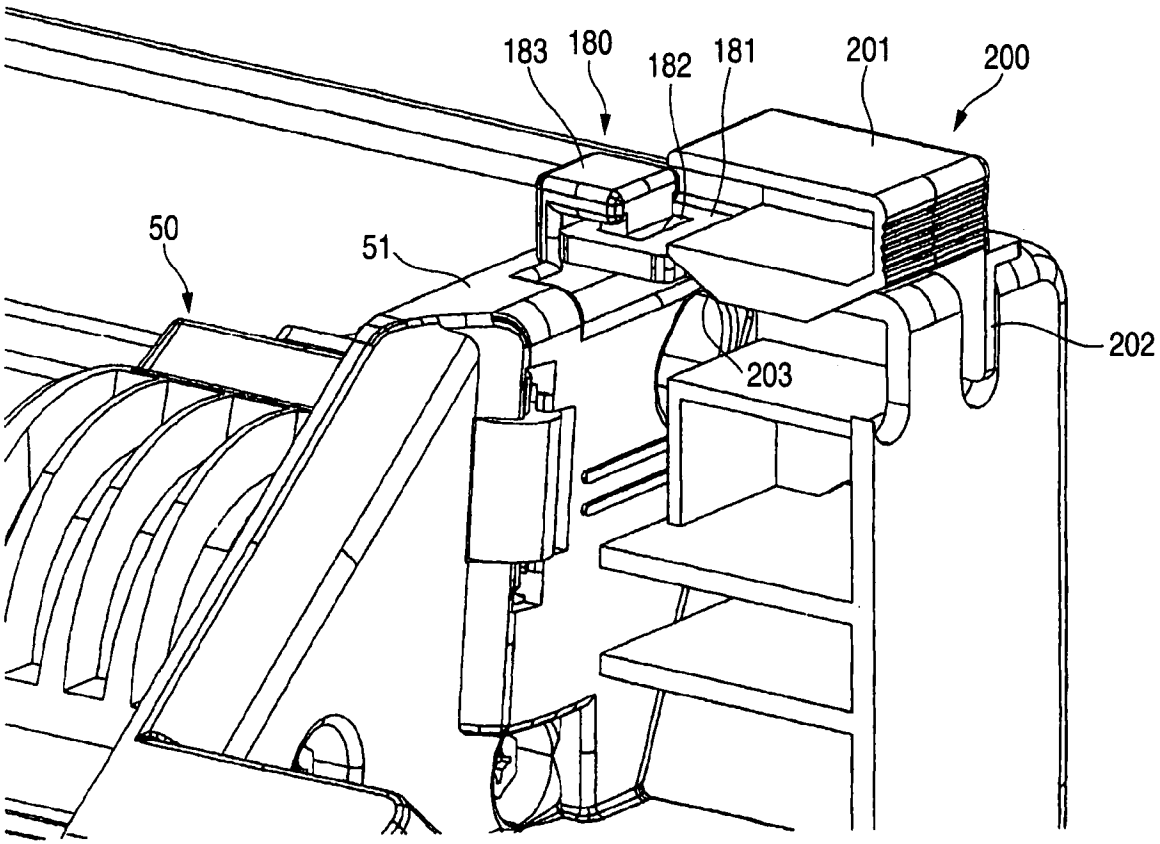
FIG. 11 is an explanatory view showing details in an area XI in FIG. 8.

On this occasion, the process cartridge 50 will be inserted into the apparatus casing 20, by pushing out the push-out lever 200 in the inserting direction of the process cartridge 50, as shown in FIG. 16(*c*). When the push-out lever 200 of the protective cover 150 which is separately provided from the process cartridge 50 is pushed out in the inserting direction of the process cartridge 50, the taper part 203 of the lever body 201 of the push-out lever 200 will push the lock arm 183 of the rock mechanism 180 downward, as shown in FIG. 11, thereby releasing the lock. In this manner, the push-out lever 200 is used also as a lock releasing member, and it is possible to easily realize the lock and release of the process cartridge 50 with respect to the protective cover 150, because this push-out lever 200 is provided separately from the process cartridge 50, and the push-out motion of the push-out lever 200 are associated with the releasing motion of the lock arm 183.

Further, when the push-out lever 200 is pushed out in the inserting direction of the process cartridge 50 along the guide slit 190 which is formed in the protective cover 150, the guides parts (the guide ridges and the guide outer wall) 61 to 63 will be guided by the guide rail 152 and the inner face of the side wall of the protective cover 150. The guide parts (the guide rails and the guide inner wall) 71 to 73 which are provided in the apparatus casing 20 are thereby inserted into the apparatus casing 20 (See FIGS. 9, 10, and 16(*c*)).

Additionally, in this exemplary embodiment, the push-out lever 200 has a pair of the leg portions 202 which are slidably engaged with the guide slit 190, and therefore, rotation of the push-out lever 200 will be prevented.

Figure 13:
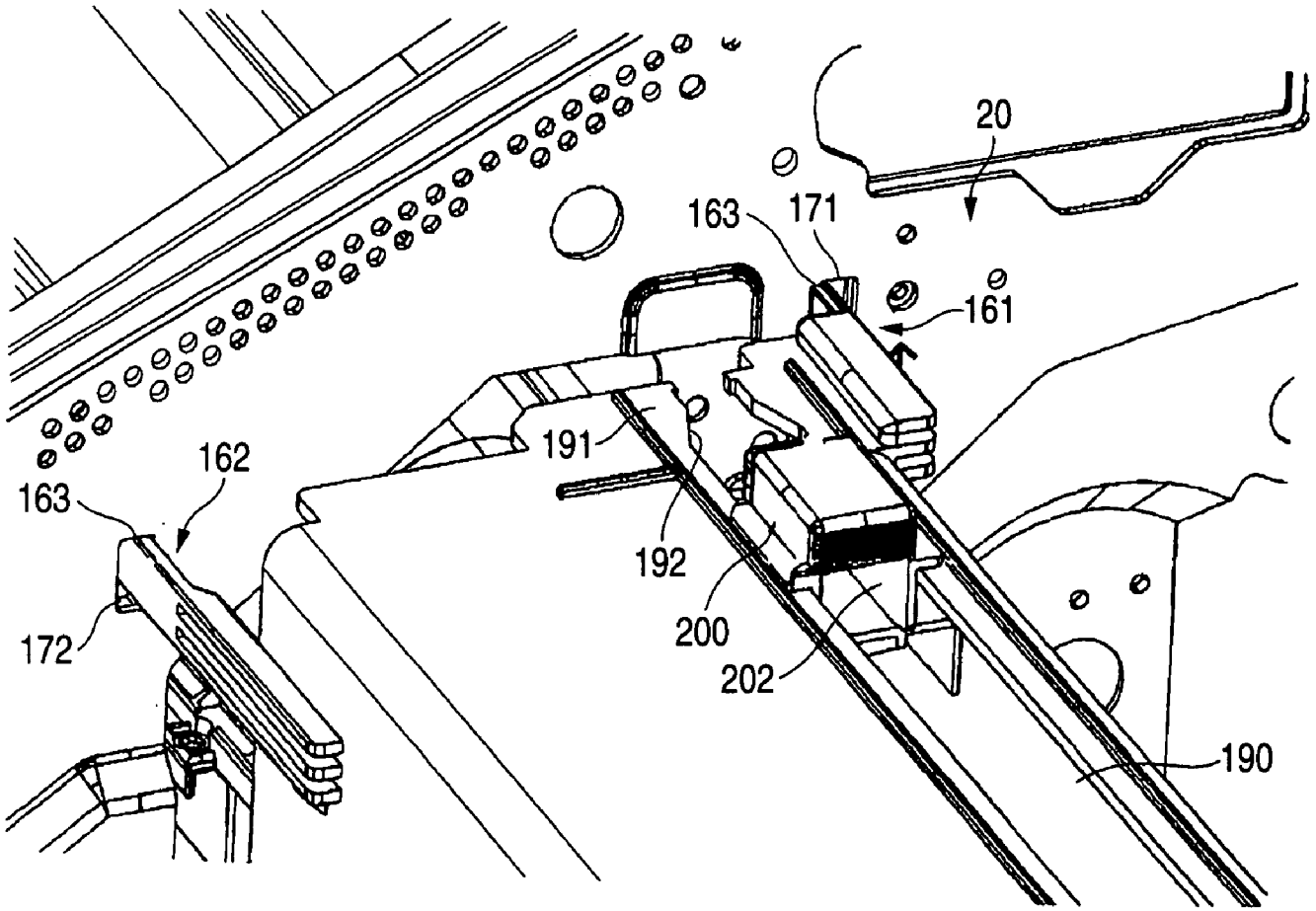
FIG. 13 is an explanatory view showing principle for releasing the protective cover from the positioned and locked state with respect to the image forming apparatus body.

In this exemplary embodiment, as shown in FIG. 13, the taper parts 192 are formed in the area before the retaining steps 191 where the gap of the guide slit 190 is narrowed. When the push-out lever 200 has been pushed out up to the position of the taper parts 192 (the position beyond a dotted line in FIG. 17(*a*)) where the gap is narrowed, as shown in FIG. 17(*a*), it will be possible to spread the position locking pieces 161, 162 which have been engaged with the position locking holes 171, 172. Accordingly, the positioned and locked state of the protective cover 150 to be irremovable by the position locking pieces 161, 162 will be released in association with the inserting motion of the process cartridge 50. In this exemplary embodiment, because the protective cover 150 is fixed to the apparatus casing 20 by the locking hooks 164 inward of the position locking pieces 161, 162, it will be possible to release the protective cover 150 from the fixed state and to remove it from the apparatus casing 20 (See FIGS. 13, and 17(*a*), (*b*)).

Because the taper parts 192 for releasing the locked state of the position locking pieces 161, 162 are formed in the guide slit 190 near the apparatus casing 20, as described above, the fixed state (positioned and locked state) of the protective cover 150 with respect to the apparatus casing 20 will be released, after the process cartridge 50 has been installed in the apparatus casing 20.

Then, the process cartridge 50 will be slid and guided in the longitudinal direction along the guide rail 152 of the protective cover 150 and the inner face of the side wall of the protective cover 150, whereby insertion of the process cartridge 50 into the apparatus casing 20 can be performed easily and smoothly. Moreover, it is possible to insert the process cartridge 50 into the apparatus casing 20 while the protective cover 150 covers a portion of the photoconductive drum 30 which has not yet been inserted. At the same time, it is possible to separate the protective cover 150 from the process cartridge 50.

Figure 17:
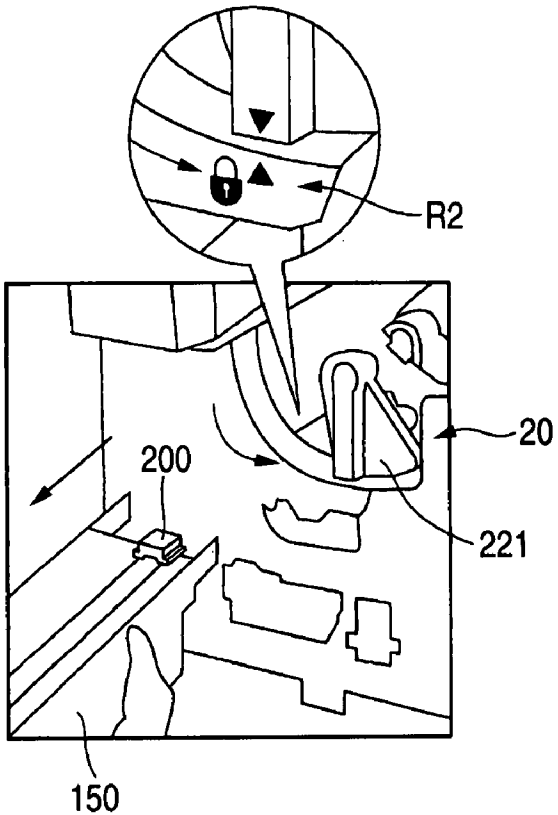
FIGS. 17(*a*) and (*b*) are explanatory views showing process of installing the process cartridge.
Figure 17:
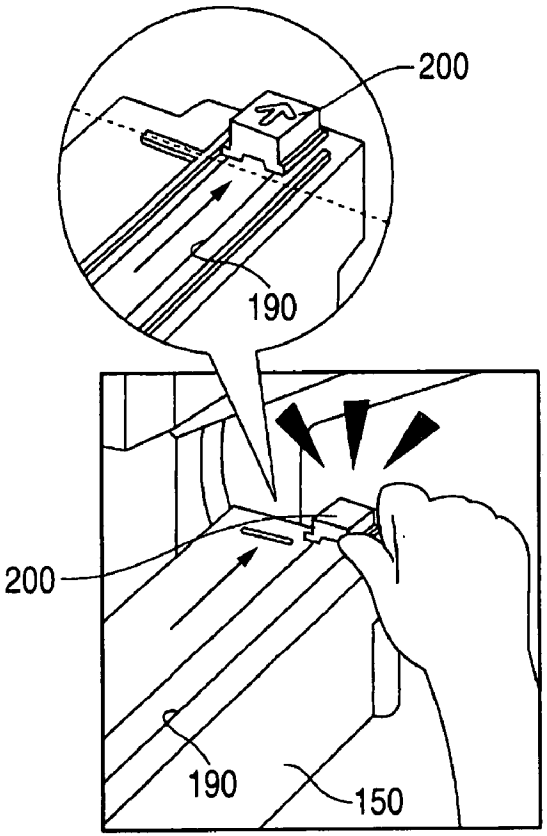
Figure 18:
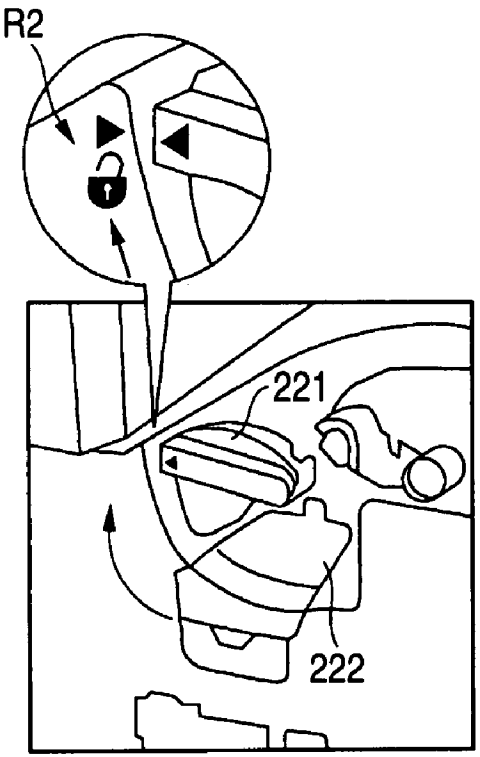
FIGS. 18(*a*) to (*c*) are explanatory views showing process of withdrawing the process cartridge.
Figure 18:
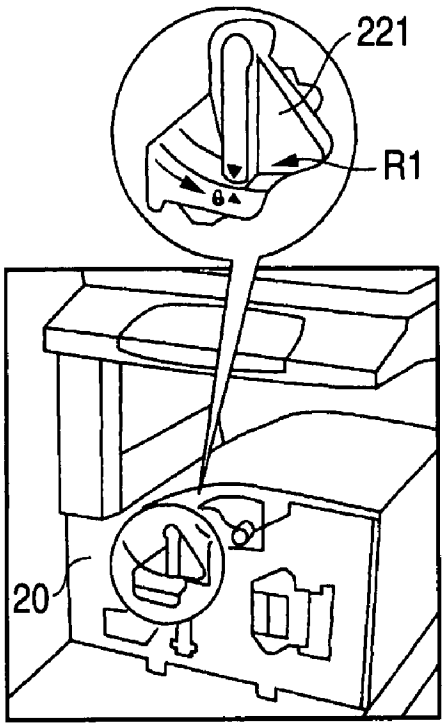
Figure 18:
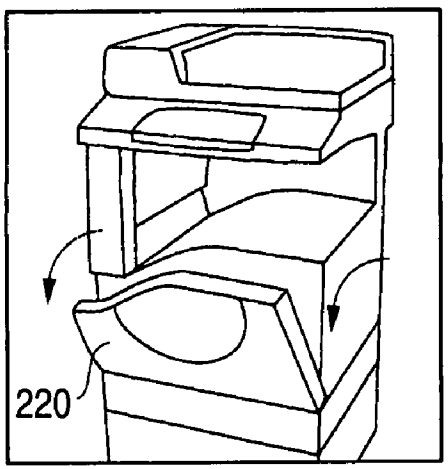

Additionally, as shown in FIG. 17(*b*), a holding plate 221 is provided so as to be rotated around a support shaft which is provided on the apparatus casing 20, between a holding position R1 where the process cartridge 50 is held with respect to the apparatus casing 20 and an open position R2 (See FIG. 18(*c*)) where the process cartridge 50 can be withdrawn from the apparatus casing 20. When the protective cover 150 has been completely detached from the apparatus casing 20, the holding plate 221 will be rotated to the holding position R1, thereby to close the cartridge insertion mouth 222 (See FIG. 16(*a*)).

Further, in this exemplary embodiment, because a gap is formed, as the guide slit 190, in the protective cover 150, there is such anxiety that light may enter into the protective cover 150 through the guide slit 190 and may deteriorate the photoconductive drum 30. It is possible to prevent intrusion of the light from the guide slit 190, by adding a flexible protective sheet 195 (See FIGS. 10 and 12) to the protective cover 150. In case where the electrifying device (the electrifying roll) 31 employing the contact electrifying method is incorporated into the process cartridge, as in this exemplary embodiment, there is such anxiety that the photoconductive drum 30 may be electrified by friction with the electrifying roll 31 during transportation or so. In this case, it is possible to prevent the contact electrification, by interposing the flexible protective sheet 195 between the electrifying roll 31 and the photoconductive drum 30. In this case, at least a part of the flexible protective sheet 195 may be exposed to the exterior of the protective cover 150, whereby it would be possible to reduce deterioration of the photoconductive drum 30, to prevent the photoconductive drum 30 from being electrified by friction with the electrifying roll 31, and to easily remove the flexible protective sheet 195 when the process cartridge 50 is inserted.

Then, a method of detaching the process cartridge from the apparatus casing will be described, referring to FIGS. 18 and 19.

As a first step, after an opening and closing cover 220 in front of the apparatus casing has been opened, the holding plate 221 for holding the process cartridge 50 with respect to the apparatus casing 20, which is provided so as to be rotated around the support shaft provided on the apparatus casing 20 between the holding position R1 where the process cartridge 50 is held with respect to the apparatus casing 20 and the open position R2 where the process cartridge 50 can be detached from the apparatus casing 20, will be rotated to the open position R2, thereby opening the cartridge insertion mouth 222 (See FIGS. 18(*b*) and (*c*)).

On this occasion, it is possible to facilitate the rotation operation, by attaching a member for damping friction of the process cartridge 50 with the holding plate 221, to a contact area between the process cartridge 50 and the holding plate 221. In this exemplary embodiment, as shown in FIGS. 3 and 4, a friction damping roll 56 is provided on the cartridge frame 51 of the process cartridge 50, but the friction damping roll may be provided on the holding plate 221. The member for damping friction is not limited to a roll structure, but various other methods are possible. For example, all or a part of the contact area may be composed of a member having less friction as compared with other places than the contact area.

Figure 19:
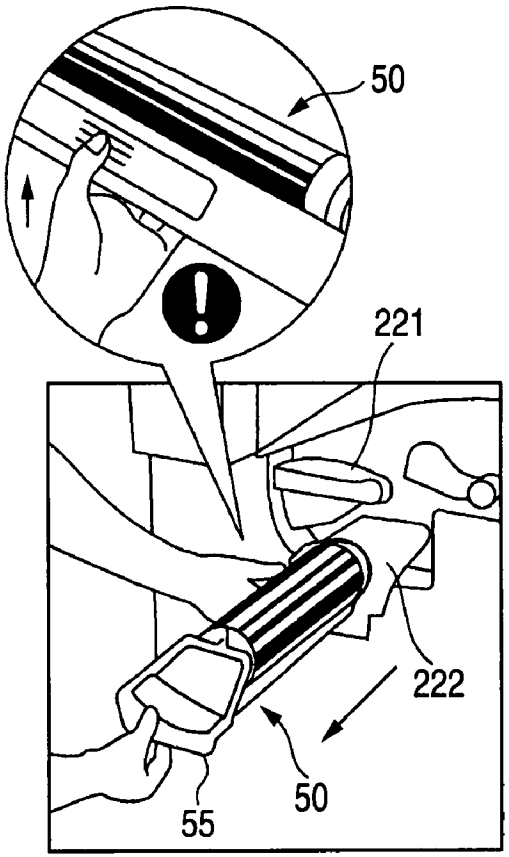
FIGS. 19(*a*) and (*b*) are explanatory views showing the process of withdrawing the process cartridge.
Figure 19:
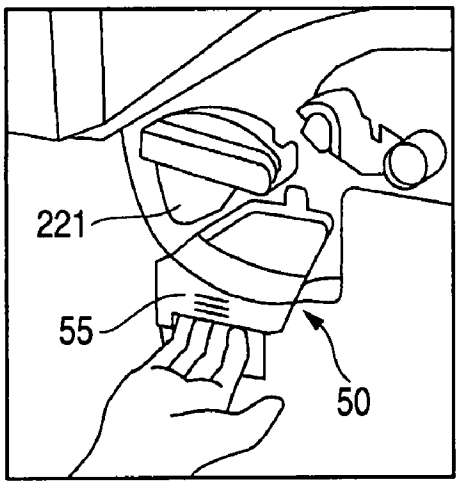

Then, by pulling out the handle 55 provided on the process cartridge 50 (See FIG. 19(*a*)), the process cartridge 50 which has been installed in the apparatus casing 20 will be detached. As shown in FIGS. 3 and 4, the process cartridge 50 is provided with the guide parts (the guide ridges and the guide outer wall) 61 to 63, and will be guided by the guide parts (the guide rails and the guide inner wall) 71 to 73 which are provided on the apparatus casing 20, thereby to be withdrawn to the exterior of the apparatus casing 20. In this exemplary embodiment, because the process cartridge 50 is adapted to be detached from the apparatus casing 20 by pulling it out, there is such anxiety that the process cartridge 50 may be hung from the opposite side to the handle 55, when the process cartridge 50 has been detached from the apparatus casing 20, and drop of the process cartridge 50 may occur, hurting the operator.

However, in this exemplary embodiment, as shown in FIGS. 14 and 15, the retaining mechanism 210 (including the movable stopper 212 provided on the apparatus casing 20 and the retaining piece 211 provided on the process cartridge 50) is provided at the backward end in the withdrawing direction of the process cartridge 50. According to this feature, because the structure for rendering the operator to stop or feel resistance against the withdrawing motion is provided at the backward end of the process cartridge 50, it is possible to draw attention of the operator, thereby to prevent the drop of the process cartridge 50 while it is detached.

For this reason, when the operator has once stopped the motion or resistance has been given by the presence of the retaining mechanism 210, he can release the retaining mechanism 210, by slightly lifting the backward end in the withdrawing direction of the process cartridge 50, as shown in FIG. 19(*b*).

As the retaining mechanism 210, the movable stopper 212 may be provided with the taper part 214 which is inclined with respect to the withdrawing direction and the inserting direction of the process cartridge 50. By making the inclination with respect to the inserting direction at a forward side smaller than the inclination with respect to the withdrawing direction at a backward side, resistance by the movable stopper 212 at the time of inserting the process cartridge 50 can be reduced. Alternatively, by making the inclination at the forward side to start from a lower position than the inclination at the backward side, it is also possible to reduce the resistance at the time of insertion. In this manner, it would be advantageous to provide the movable stopper 212 having such a shape that the retaining piece 211 of the process cartridge 50 may be butted against only the taper part 214 of the movable stopper 212, when the process cartridge 50 is inserted, and may be butted against the substantially vertical plane of the movable stopper 212, when the process cartridge 50 is withdrawn.

Particularly, in this exemplary embodiment, in addition to the above described structure, the movable stopper 212 is provided with the spring 213 which is movable in the vertical direction. Therefore, it is possible to further reduce the resistance against the insertion of the process cartridge 50, and to give the resistance enough to draw attention of the operator at the time of withdrawal (See FIG. 15).

Moreover, although the movable stopper 212 is provided on the apparatus casing 20, and the retaining piece 211 to be engaged with the movable stopper 212 is provided on the process cartridge 50 in this exemplary embodiment, the invention is not limited to this case. It is also possible to provide the movable stopper on the process cartridge 50, and to provide the retaining piece to be engaged with the movable stopper, on the apparatus casing. However, in view of size reduction of the process cartridge 50 and cost saving, which arises from a larger production number of the process cartridge 50 as compared with the image forming apparatus, it would be desirable that the movable stopper is provided on the image forming apparatus, as in this exemplary embodiment.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A protective cover comprising:

a cover body detachably mounted on a process cartridge to protect at least an outwardly exposed part of an electrophotographic photoreceptor;

a guide part that is provided on the cover body to guide the process cartridge in a longitudinal direction of the electro-photographic photoreceptor; and a position locking part including a hook that is provided at a forward end of the cover body in a direction that the process cartridge is inserted into an image forming apparatus, the cover body being positioned and locked to the image forming apparatus to be irremovable and forming a locked state during an installation of the process cartridge into the image forming apparatus, and the locked state is released after the installation is complete.

2. The protective cover as claimed in claim 1, wherein the position locking part positions the cover body and locks the cover body to be irremovable.

3. The protective cover as claimed in claim 1, wherein the position locking part comprises a plurality of locking pieces that can be positioned and locked with a plurality of position locking holes that are formed on the image forming apparatus.

4. The protective cover as claimed in claim 3, wherein the plurality of locking pieces can be elastically deformed, and a locking hook is provided at the distal end of each locking piece that locks with an edge of one of plurality of position locking holes.

5. The protective cover as claimed in claim 1, wherein the position locking part can be released from the locked state when the process cartridge is inserted into the image forming apparatus.

6. The protective cover as claimed in claim 5, wherein the cover body further comprises a push-out part that freely moves and pushes out the process cartridge that is inserted into the image forming apparatus, and the push-out part releases the locked state after the process cartridge has been installed by the push-out part.

7. The protective cover as claimed in claim 1, wherein the cover body further comprises a cartridge fixing part to which at least a part of the process cartridge is fixed to form a fixed state, and the cartridge fixing part releases the fixed state when the installation of the process cartridge into the image forming apparatus begins.

8. The protective cover as claimed in claim 7, wherein the cover body further comprises a push-out part that freely moves and pushes out the process cartridge that is inserted into the image forming apparatus, and the push-out part releases the fixed state when the push-out part starts to push out the process cartridge.

9. A process cartridge that is detachably inserted and installed into an image forming apparatus, comprising an electro-photographic photoreceptor and a cartridge frame that houses the electro-photographic photoreceptor, the cartridge frame comprising a protective cover, the protective cover comprising:

a cover body detachably mounted on the cartridge frame to protect at least an outwardly exposed part of the electro-photographic photoreceptor;

a guide part that is provided on the cover body to guide the cartridge frame in a longitudinal direction of the electro-photographic photoreceptor; and a position locking part including a hook that is provided at a forward end of the cover body in a direction that the cartridge frame is inserted into the image forming apparatus, wherein the cover body is positioned and locked to the image forming apparatus to be irremovable and forming a locked state during an installation of the cartridge frame into the image forming apparatus, and the locked state is released after the installation is complete.

10. The process cartridge as claimed in claim 9, further comprising a retaining part provided in the cartridge frame at a backward end in a withdrawing direction of the cartridge frame, wherein the retaining part engages with the image forming apparatus at the backward end in a withdrawing direction of the cartridge frame when the cartridge frame is withdrawn from the image forming apparatus, thereby temporarily stopping a withdrawing motion.

11. An image forming apparatus comprising a process cartridge having an electro-photographic photoreceptor, the process cartridge being detachably inserted and installed into the image forming apparatus, the image forming apparatus further comprising a protective cover that protects at least an outwardly exposed part of the electro-photographic photoreceptor before an installation of the process cartridge in the image forming apparatus and during the installation, and the protective cover detaches from the process cartridge after the installation is complete, wherein the protective cover comprises:

a cover body detachably mounted on the process cartridge to protect at least an outwardly exposed part of the electro-photographic photoreceptor;

a guide part that is provided on the cover body to guide the process cartridge in a longitudinal direction of the electro-photographic photoreceptor; and a position locking part including a hook that is provided at a forward end of the cover body in a direction that the process cartridge is inserted into the image forming apparatus, wherein the cover body is positioned and locked with respect to the image forming apparatus to be irremovable and forming a locked state during an installation of the process cartridge into the image forming apparatus, and the locked state is released after the installation is complete.

12. The image forming apparatus as claimed in claim 11, further comprising a stopper provided on the image forming apparatus body; and a retaining part provided at a backward end of the process cartridge in a withdrawing direction, that engages with the stopper when the process cartridge is withdrawn from the image forming apparatus body, thereby temporarily stopping the withdrawing motion.

13. A method of detachably inserting and installing a process cartridge having an electro-photographic photoreceptor into an image forming apparatus, comprising:

positioning and locking a protective cover, that is detachably mounted on a process cartridge using a hook and covers at least the electro-photographic photoreceptor, to the image forming apparatus to be irremovable;

guiding and inserting the process cartridge along the protective cover that has been positioned and locked to the image forming apparatus; and releasing the protective cover that was positioned and locked to the image forming apparatus, after the process cartridge has been inserted.

* * * * *